US011046079B2

(12) United States Patent
Higuchi et al.

(10) Patent No.: US 11,046,079 B2
(45) Date of Patent: Jun. 29, 2021

(54) LIQUID ABSORBER AND LIQUID EJECTION APPARATUS

(71) Applicant: SEIKO EPSON CORPORATION, Tokyo (JP)

(72) Inventors: Naotaka Higuchi, Fujimi-machi (JP); Masahiko Nakazawa, Nagano (JP); Shogo Nakada, Nagano (JP); Yoichi Miyasaka, Nagano (JP); Kaneo Yoda, Nagano (JP); Nobutaka Urano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/752,760

(22) Filed: Jan. 27, 2020

(65) Prior Publication Data

US 2020/0238705 A1 Jul. 30, 2020

(30) Foreign Application Priority Data

Jan. 28, 2019 (JP) ..... JP2019-012453

(51) Int. Cl.
*B41J 2/17* (2006.01)
*B41J 2/165* (2006.01)

(52) U.S. Cl.
CPC ..... *B41J 2/16523* (2013.01); *B41J 2/1721* (2013.01)

(58) Field of Classification Search
CPC ..... B41J 2/16523; B41J 2/1721
See application file for complete search history.

(56) References Cited

U.S. PATENT DOCUMENTS

| | | | | |
|---|---|---|---|---|
| 8,096,636 | B2 | 1/2012 | Katoh | |
| 10,858,212 | B2 | 12/2020 | Salehuddin et al. | |
| 2008/0158294 | A1 | 7/2008 | Katoh | |
| 2008/0297575 | A1* | 12/2008 | Asaki | B41J 2/16505 347/86 |
| 2017/0090400 | A1 | 3/2017 | Maruyama et al. | |
| 2018/0296403 | A1 | 10/2018 | Kobayashi et al. | |
| 2018/0312362 | A1 | 11/2018 | Salehuddin et al. | |
| 2019/0240982 | A1* | 8/2019 | Wada | B41J 29/13 |
| 2020/0164653 | A1* | 5/2020 | Miyasaka | B41J 2/16508 |

FOREIGN PATENT DOCUMENTS

| | | | | |
|---|---|---|---|---|
| CN | 108024885 A | | 5/2018 | |
| CN | 109955595 A | * | 7/2019 | B41J 2/16505 |
| JP | 08216423 A | * | 8/1996 | |
| JP | 2004-065052 A | | 3/2004 | |
| JP | 3536870 B2 | | 6/2004 | |
| JP | 4999486 B2 | | 8/2012 | |

* cited by examiner

*Primary Examiner* — Sharon Polk
(74) *Attorney, Agent, or Firm* — Global IP Counselors, LLP

(57) ABSTRACT

A liquid absorber includes a liquid absorption member, a case, and a cover. The liquid absorption member absorbs liquid. The liquid absorption member includes a fiber and a liquid-absorbent resin. The liquid absorption member is stored in the case. The cover covers the liquid absorption member. The cover includes through-holes through which the liquid is to pass. The cover includes a recessed portion recessed toward the liquid absorption member. The recessed portion is disposed at a location to which the liquid is to be discharged. The through-holes are disposed at least in the recessed portion.

12 Claims, 24 Drawing Sheets

LIQUID ABSORBER AND LIQUID EJECTION APPARATUS

The present application is based on, and claims priority from JP Application Serial Number 2019-012453, filed Jan. 28, 2019, the disclosure of which is hereby incorporated by reference herein in its entirety.

BACKGROUND

1. Technical Field

The present disclosure relates to a liquid absorber and a liquid ejection apparatus.

2. Related Art

In ink jet printers, waste ink is typically generated during a head cleaning operation, which is performed to prevent a reduction in printing quality due to nozzle clogging caused by the drying of ink, and during an ink filling operation after a replacement of an ink cartridge. To absorb waste ink, a liquid absorber including a liquid absorption member is used.

For example, Japanese Patent No. 3536870 describes a liquid absorption member that absorbs liquid. The liquid absorption member is formed primarily of a fiber and includes a fused resin.

Unfortunately, in the liquid absorption member of Japanese Patent No. 3536870, the individual fibers are fused to one another with a fused resin, and, therefore, the liquid absorption member has a high bulk density. As such, the liquid absorption member has insufficient liquid absorption properties. In addition, the liquid absorption member needs to be processed to fit the shape of the case in which the liquid absorption member is to be stored, and, therefore, the liquid absorption member has low versatility and incurs high processing costs.

Correspondingly, the development of liquid absorption members that can conform to the shape of any desired case and can be provided at reduced processing costs is being advanced. Examples of such liquid absorption members include an assembly of crushed pieces and a fibrillated cotton fiber.

However, with a liquid absorption member that conforms to the shape of any desired case, it is difficult to provide and maintain a shape of a recessed portion. The recessed portion is a portion provided to prevent waste ink from spilling to the outside during the discharging of the waste ink, which may otherwise occur due to formation of bubbles.

SUMMARY

An embodiment of a liquid absorber according to the present disclosure includes a liquid absorption member, a case, and a cover. The liquid absorption member absorbs liquid. The liquid absorption member includes a fiber and a liquid-absorbent resin. The liquid absorption member is stored in the case. The cover covers the liquid absorption member. The cover includes through-holes through which the liquid is to pass. The cover includes a recessed portion recessed toward the liquid absorption member. The recessed portion is disposed at a location to which the liquid is to be discharged. The through-holes are disposed at least in the recessed portion.

In another embodiment of the liquid absorber, the recessed portion may include a bottom portion and a sidewall portion, and the through-holes may be disposed in the bottom portion.

In another embodiment of the liquid absorber, some of the through-holes may be disposed in the sidewall portion.

In another embodiment of the liquid absorber, the cover may include a peripheral portion, the peripheral portion being a portion other than the recessed portion, and some of the through-holes may be disposed in the peripheral portion.

In another embodiment of the liquid absorber, the bottom portion may include protruding portions protruding toward the liquid absorption member.

In another embodiment of the liquid absorber, openings of the through-holes may have a maximum length of 0.67 mm or greater and 8.01 mm or less, and openings of the through-holes may have an area of 0.18 $mm^2$ or greater and 64 $mm^2$ or less.

In another embodiment of the liquid absorber, the cover may have an open area fraction of 0.08% or greater and 95% or less.

In another embodiment of the liquid absorber, the open area fraction of the cover may be 2.19% or greater and 80% or less.

In another embodiment of the liquid absorber, the liquid absorption member may include an assembly of small pieces, and each of the small pieces may include a substrate and the liquid-absorbent resin. The substrate may include the fiber, and the liquid-absorbent resin may be supported by the substrate.

In another embodiment of the liquid absorber, the liquid-absorbent resin may be held between a pair of portions of the substrate.

An embodiment of a liquid absorber according to the present disclosure includes a liquid absorption member, a case, and a cover. The liquid absorption member absorbs liquid. The liquid absorption member includes a fiber and a liquid-absorbent resin. The liquid absorption member is stored in the case. The cover covers the liquid absorption member. The cover includes through-holes through which the liquid is to pass. The cover includes a sidewall portion that surrounds at least a portion of a location of the cover. The location is a location to which the liquid is to be discharged. The through-holes are disposed in the location to which the liquid is to be discharged.

An embodiment of a liquid ejection apparatus according to the present disclosure includes a liquid ejection head and the liquid absorber of any of the above embodiments. The liquid absorber is configured to absorb the liquid, the liquid being ejected from the liquid ejection head.

DESCRIPTION OF EXEMPLARY EMBODIMENTS

Preferred embodiments of the present disclosure will now be described in detail with reference to the drawings. Note that the embodiments described below are not intended to unduly limit the content of the present disclosure described in the claims. Furthermore, not all of the configurations described below may be essential configuration requirements of the present disclosure.

1. LIQUID ABSORBER

Figure 1:
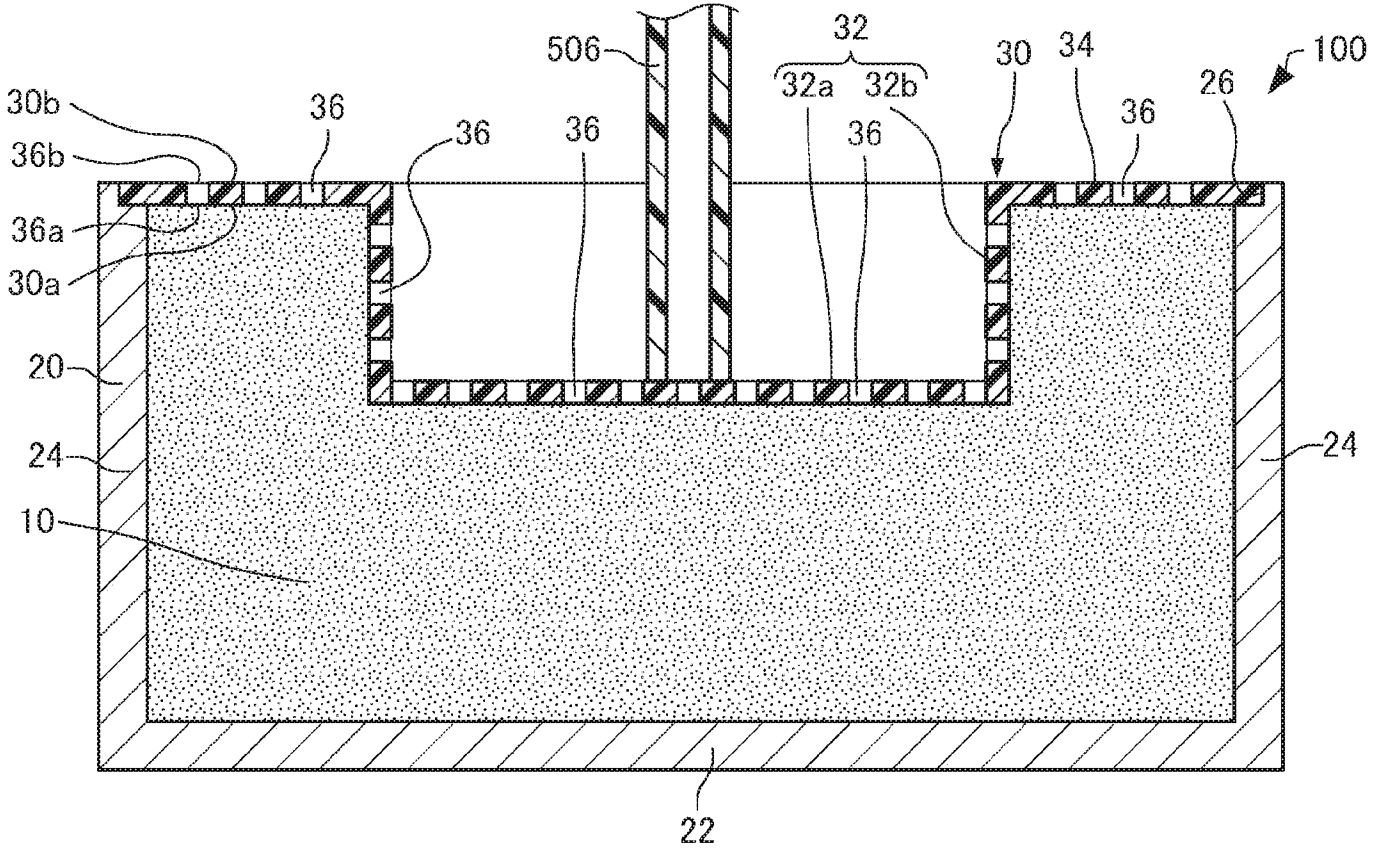
FIG. 1 is a schematic cross-sectional view of a liquid absorber, according to an embodiment.
Figure 2:
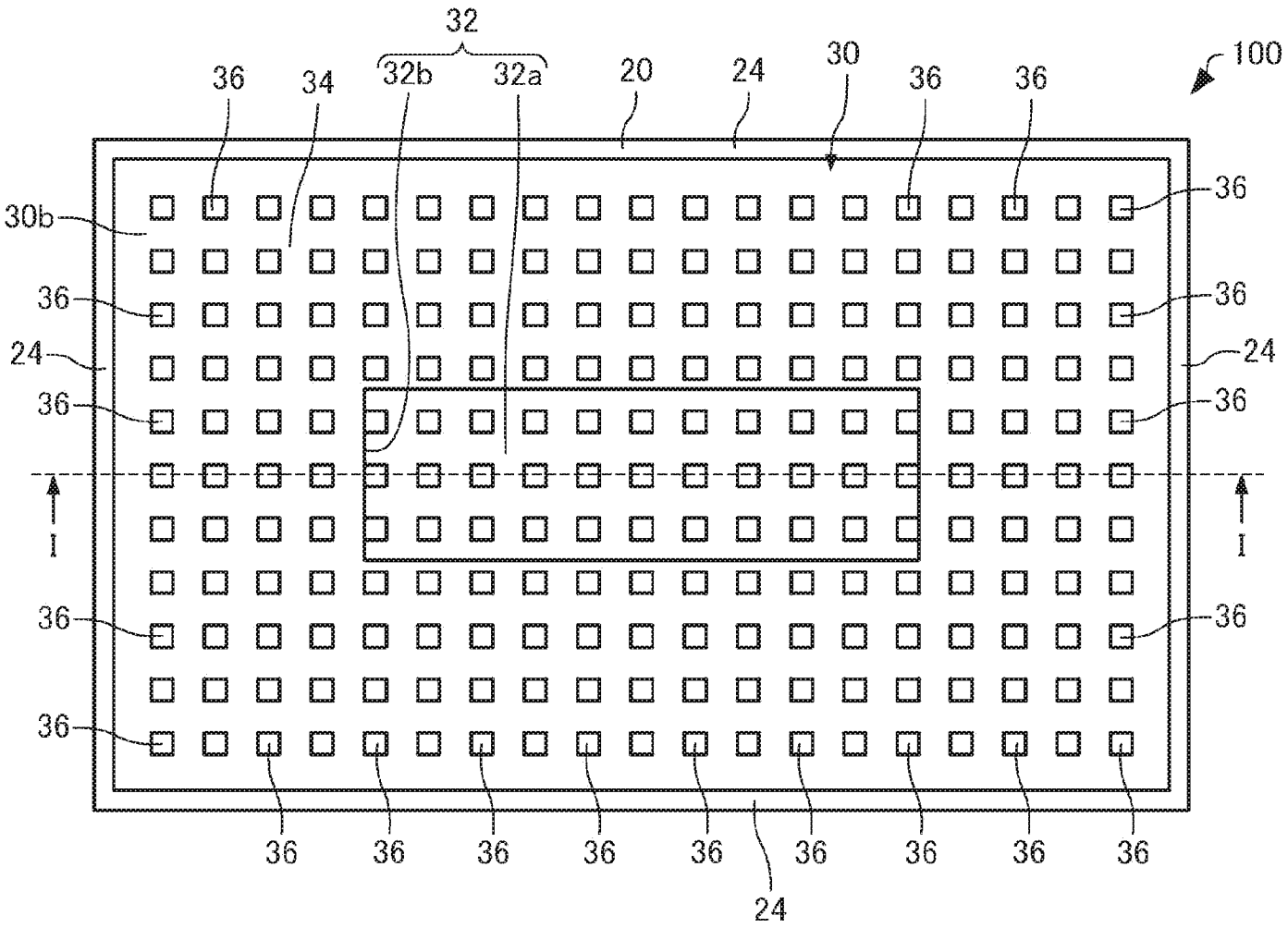
FIG. 2 is a schematic plan view of the liquid absorber according to the embodiment.

First, a liquid absorber according to an embodiment will be described with reference to the drawings. FIG. 1 is a schematic cross-sectional view of a liquid absorber 100, according to an embodiment. FIG. 2 is a schematic plan view of the liquid absorber 100 according to the embodiment. Note that FIG. 1 is a cross-sectional view taken along line I-I of FIG. 2.

As illustrated in FIG. 1 and FIG. 2, the liquid absorber 100 includes a liquid absorption member 10, a case 20, and a cover 30. Note that, in FIG. 1 and FIG. 2, the liquid absorption member 10 is illustrated in a simplified manner for convenience. Furthermore, a tube 506 is omitted in FIG. 2. In the following description, each of the elements will be described.

1.1. Liquid Absorption Member

The liquid absorption member 10 absorbs liquid. Specifically, the liquid absorption member 10 absorbs inks, such as an aqueous ink in which a colorant is dissolved in an aqueous solvent, a solvent-based ink in which a binder is dissolved in a solvent, a UV (ultraviolet) curable ink in which a binder is dissolved in a liquid monomer that is cured by UV irradiation, and a latex ink in which a binder is dispersed in a dispersion medium. The following description is made assuming that the liquid absorbed by the liquid absorption member 10 is ink.

The liquid absorption member 10 includes individual fibers and liquid-absorbent resin particles. The liquid absorption member 10 may include an adhesive. In the following description, the fiber, the liquid-absorbent resin, and the adhesive that are included in the liquid absorption member 10 will be described in the order mentioned.

1.1.1. Fiber

Examples of the fiber that is included in the liquid absorption member 10 include synthetic resin fibers, such as polyester fibers and polyamide fibers, and natural resin fibers, such as cellulose fibers, keratinous fibers, and fibroin fibers.

It is preferable that the fiber that is included in the liquid absorption member 10 be a cellulose fiber. Cellulose fibers are hydrophilic materials, and, therefore, when ink is provided to a cellulose fiber, the cellulose fiber can suitably take in the ink. In addition, the cellulose fiber can suitably deliver the ink that is taken temporarily to a liquid-absorbent resin. Hence, the liquid absorption member 10 can have excellent absorption characteristics with respect to ink. Furthermore, cellulose fibers have a high affinity for liquid-absorbent resins and, therefore, can suitably support a liquid-absorbent resin on a surface of the fibers. Furthermore, cellulose fibers are renewable natural materials and are inexpensive and readily available compared with various other fibers. As such, cellulose fibers are advantageous also from the standpoint of reducing the production cost, ensuring stable production, and reducing environmental impact, for example.

Note that it is sufficient that the cellulose fiber be a fibrous material containing, as a major component, cellulose included in a compound, and the compound may include hemicellulose and/or lignin in addition to cellulose.

An average length of the individual fibers is preferably 0.1 mm or greater and 7 mm or less, more preferably 0.1 mm or greater and 5 mm or less, and even more preferably 0.1 mm or greater and 3 mm or less. An average width of the individual fibers is preferably 0.5 μm or greater and 200 μm or less and more preferably 1.0 μm or greater and 100 μm or less. An average aspect ratio of the individual fibers is preferably 10 or greater and 1000 or less and more preferably 15 or greater and 500 or less. The average aspect ratio is the ratio of the average length to the average width.

When the above-mentioned ranges are satisfied, the fiber can support a liquid-absorbent resin, hold ink, and deliver the ink to the liquid-absorbent resin in a suitable manner, and, hence, the liquid absorption member 10 has excellent absorption characteristics with respect to ink.

Figure 3:
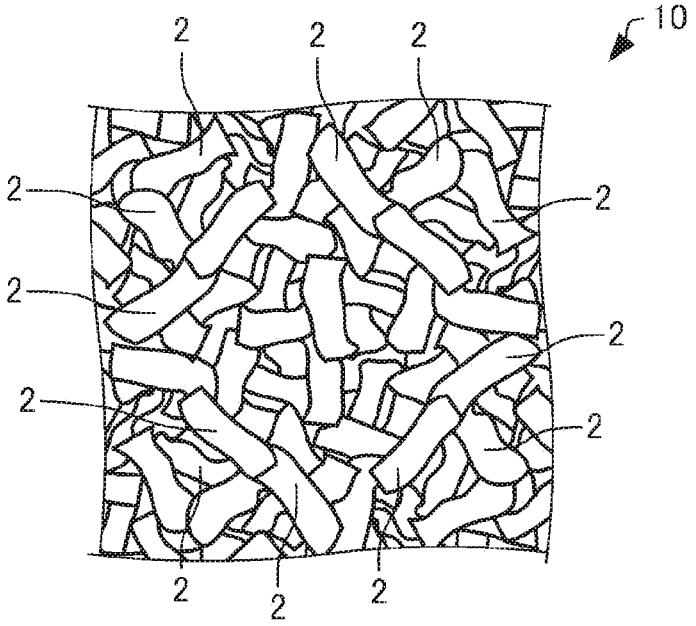
FIG. 3 is a diagram illustrating a liquid absorption member loaded in a liquid absorber, according to an embodiment.
Figure 4:
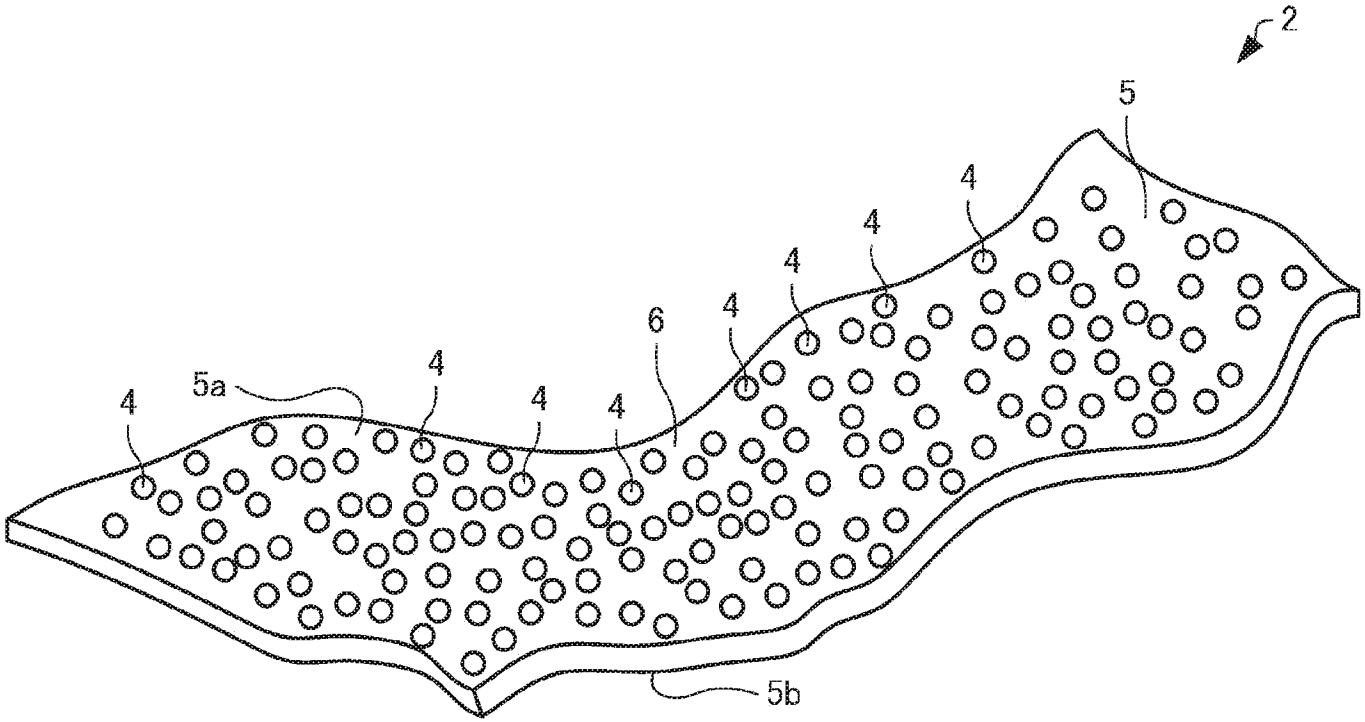
FIG. 4 is a diagram illustrating a small piece that is included in a liquid absorption member, which is loaded in a liquid absorber, according to an embodiment.
Figure 5:
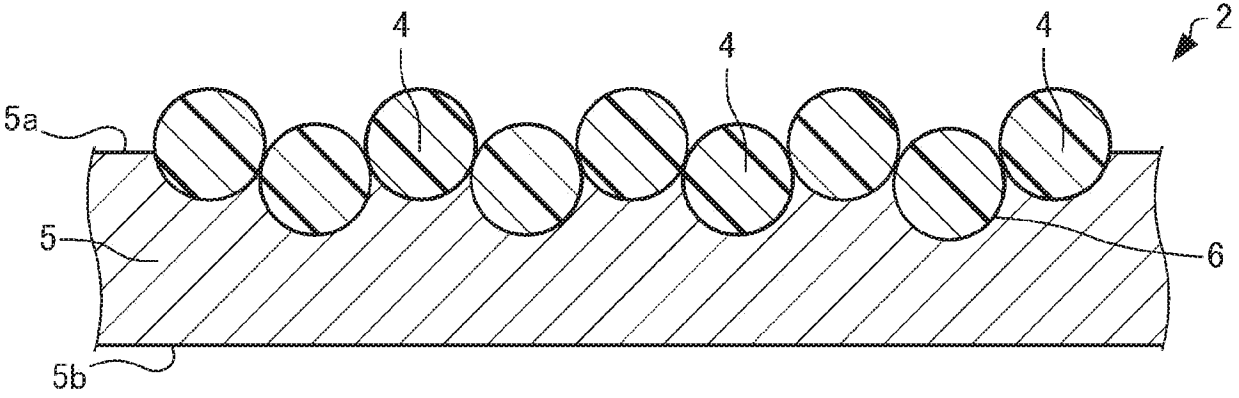
FIG. 5 is a diagram illustrating a small piece that is included in a liquid absorption member, which is loaded in a liquid absorber, according to an embodiment.

FIG. 3 is a diagram illustrating an assembly of small pieces 2, which is included in the liquid absorption member 10. FIG. 4 and FIG. 5 are diagrams illustrating a substrate 5, a liquid-absorbent resin 4, and an adhesive 6, which are included in the small pieces 2. The substrate 5 includes the individual fibers.

As illustrated in FIG. 3, the liquid absorption member 10 includes the small pieces 2. The small pieces 2 are chip-shaped pieces obtained by, for example, finely cutting paper with a shredder or the like. The paper may be a sheet of waste paper or the like on which the liquid-absorbent resin 4 is supported (sheet member 3, which will be described later). It is preferable that the small pieces 2 be strip-shaped pieces having flexibility. With this configuration, the small pieces 2 can be easily deformed. Hence, when the liquid absorption member 10 is stored in the case 20, the liquid absorption member 10 is deformed regardless of the shape of the case 20 and, therefore, can be stored therein without difficulty.

A full length of the small pieces 2, that is, a length in a longitudinal direction of the small pieces 2, is preferably 0.5 mm or greater and 200 mm or less, more preferably 1 mm or greater and 100 mm or less, and even more preferably 2 mm or greater and 30 mm or less.

A width of the small pieces 2, that is, a length in a transverse direction of the small pieces 2, is preferably 0.1 mm or greater and 100 mm or less, more preferably 0.3 mm or greater and 50 mm or less, and even more preferably 1 mm or greater and 10 mm or less.

The aspect ratio between the full length and the width of the small pieces 2 is preferably 1 or greater and 200 or less and more preferably 1 or greater and 30 or less. A thickness of the small pieces 2 is preferably 0.05 mm or greater and 2 mm or less and more preferably 0.1 mm or greater and 1 mm or less.

When the above-mentioned ranges are satisfied, the fiber can support a liquid-absorbent resin, hold ink, and deliver the ink to the liquid-absorbent resin in a suitable manner, and, hence, the liquid absorption member 10 has excellent absorption characteristics with respect to ink. In addition, the liquid absorption member 10 can be easily deformed and, therefore, has improved conformability to the shape of the case 20.

Note that in the liquid absorption member 10, some of the small pieces 2 may be the same as one another in terms of at least one of full length, width, aspect ratio, and thickness, and some of the small pieces 2 may be different from one another in terms of length, width, aspect ratio, and thickness.

It is preferable that the small pieces 2 have a regular shape. When the small pieces 2 have a regular shape, it is unlikely that variations will occur in a bulk density of the liquid absorption member 10, and, therefore, variations in the ink absorption characteristics are prevented from occurring. In the liquid absorption member 10, a content of small pieces 2 that have a regular shape is greater than or equal to 30 wt. % relative to the total weight of the liquid absorption member 10. The content is preferably greater than or equal to 50 wt. % and more preferably greater than or equal to 70 wt. %.

For example, the small pieces 2 are stored in the case 20 randomly, without regularity, in a manner such that the longitudinal directions of the small pieces 2 do not extend parallel to one another but extend crosswise to one another. Thus, gaps can be easily formed between the small pieces 2. As a result, ink can flow through the gaps, and, when the gaps are very small, ink can wet and spread under capillary action. Accordingly, ink flowability is ensured. Hence, in the case 20, ink flowing downwardly is prevented from being blocked along the way, and as a result, the ink can penetrate to a bottom portion 22 of the case 20.

Since the small pieces 2 are stored randomly, the opportunity for the liquid absorption member 10 as a whole to come into contact with ink is increased, and, hence, the liquid absorption member 10 has excellent absorption characteristics with respect to ink. Furthermore, in the process of storing the liquid absorption member 10 into the case 20, the small pieces 2 can be thrown into the case 20 in a random manner, and, therefore, the operation can be carried out readily and quickly.

The bulk density of the liquid absorption member 10 is preferably 0.01 g/cm$^3$ or greater and 0.5 g/cm$^3$ or less, more preferably 0.03 g/cm$^3$ or greater and 0.3 g/cm$^3$ or less, and even more preferably 0.05 g/cm$^3$ or greater and 0.2 g/cm$^3$ or less. Such a bulk density realizes both an ink retention characteristic and an ink penetration characteristic.

1.1.2. Liquid-Absorbent Resin

As illustrated in FIG. 4 and FIG. 5, the particles of the liquid-absorbent resin 4, which are included in the small pieces 2, are supported on the substrate 5. In the illustrated example, the particles of the liquid-absorbent resin 4 are supported only on one surface 5*a* of the substrate 5. Although not illustrated, some or all of the particles of the liquid-absorbent resin 4 may be supported on another surface 5*b* of the substrate 5. Thus, the small piece 2 is formed of the substrates 5 that include the particles of the liquid-absorbent resin supported thereon.

As illustrated in FIG. 5, the particles of the liquid-absorbent resin 4 may be partially embedded in the one surface 5*a* of the substrate 5. That is, the particles of the liquid-absorbent resin 4 may be partially enclosed in the substrate 5. This configuration increases the ability of the substrate 5 to support the particles of the liquid-absorbent resin 4. Hence, the particles of the liquid-absorbent resin 4 are prevented from falling off the substrate 5. As a result, the liquid absorption member 10, which is formed of an assembly of the small pieces 2, exhibits excellent absorption characteristics with respect to ink over a long period of time. In addition, uneven distribution of the particles of the liquid-absorbent resin 4 in the case 20 is prevented.

Note that the particles of the liquid-absorbent resin 4 may not be partially embedded in the surface 5*a* of the substrate 5. The particles of the liquid-absorbent resin 4 may be applied to the substrate 5 and may merely adhere to the substrate 5.

The liquid-absorbent resin 4 is a super absorbent polymer (SAP) having liquid absorption characteristics. The term "liquid absorption" refers to properties of having a hydrophilicity and retaining liquid. The liquid-absorbent resin 4 may be gelled by absorption of liquid. Specifically, the liquid-absorbent resin 4 absorbs liquid present in ink, such as water and a hydrophilic organic solvent.

Examples of the liquid-absorbent resin 4 include carboxymethyl cellulose, polyacrylic acids, polyacrylamides, starch-acrylic acid graft copolymers, hydrolysates of starch-acrylonitrile graft copolymers, vinyl acetate-acrylic ester copolymers, isobutylene-maleic acid copolymers, hydrolysates of acrylonitrile copolymers or acrylamide copolymers, polyethylene oxide, polysulfonic acid compounds, polyglutamic acids, salts thereof, modified products thereof, and crosslinked products thereof.

It is preferable that the liquid-absorbent resin 4 be a resin including structural units that contain a functional group in a side chain. Examples of the functional group include acid groups, hydroxyl groups, epoxy groups, and amino groups. In particular, it is preferable that an acid group be present in the side chain of the resin, and it is more preferable that a carboxyl group be present in the side chain of the resin.

Examples of a carboxyl-group-containing unit that may be included in the side chain include units derived from a monomer such as acrylic acid, methacrylic acid, itaconic acid, maleic acid, crotonic acid, fumaric acid, sorbic acid, cinnamic acid, an anhydride of any of the foregoing acids, or a salt of any of the foregoing acids.

When the liquid-absorbent resin 4 is a resin including structural units that contain an acid group in a side chain, a percentage of acid groups of the liquid-absorbent resin 4 that are neutralized and form a salt, relative to the total moles of acid groups in the liquid-absorbent resin 4, is preferably 30 mol % or greater and 100 mol % or less, more preferably 50 mol % or greater and 95 mol % or less, even more preferably 60 mol % or greater and 90 mol % or less, and most preferably 70 mol % or greater and 80 mol % or less. Such a liquid-absorbent resin 4 has excellent absorption characteristics with respect to ink.

Examples of the neutralized salt include alkali metal salts, such as sodium salts, potassium salts, and lithium salts, and salts of a nitrogen-containing basic compound, such as ammonia. In particular, a sodium salt is preferable. Such a liquid-absorbent resin 4 has excellent absorption characteristics with respect to ink.

In a liquid-absorbent resin 4 including structural units that contain an acid group in a side chain, electrostatic repulsion occurs between acid groups during absorption of ink, which increases the absorption rate. Thus, such a liquid-absorbent resin 4 is preferable. Furthermore, in the instance in which acid groups are neutralized, ink can be easily absorbed into the liquid-absorbent resin 4 under osmotic pressure.

The liquid-absorbent resin 4 may have a structural unit in which no acid group is present in a side chain. Examples of such a structural unit include hydrophilic structural units, hydrophobic structural units, and structural units that serve as a polymerizable crosslinking agent.

Examples of the hydrophilic structural units include structural units derived from a nonionic compound, such as acrylamide, methacrylamide, N-ethyl (meth)acrylamide, N-n-propyl (meth)acrylamide, N-isopropyl (meth)acrylamide, N,N-dimethyl (meth)acrylamide, 2-hydroxyethyl (meth)acrylate, 2-hydroxypropyl (meth)acrylate, methoxypolyethylene glycol (meth)acrylate, polyethylene glycol mono(meth)acrylate, N-vinylpyrrolidone, N-acryloylpiperidine, or N-acryloylpyrrolidine.

Examples of the hydrophobic structural units include structural units derived from a compound such as (meth) acrylonitrile, styrene, vinyl chloride, butadiene, isobutene, ethylene, propylene, stearyl (meth)acrylate, or lauryl (meth) acrylate.

Examples of the structural units that serve as a polymerizable crosslinking agent include structural units derived from a compound such as diethyleneglycol diacrylate, N,N-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanurate diacrylate, tetraallyloxyethane, or a salt of diallyloxyacetic acid.

It is preferable that the liquid-absorbent resin 4 include a polyacrylic acid salt copolymer or a crosslinked polyacrylic acid polymer. Such a liquid-absorbent resin 4 exhibits improved ink absorption performance and enables a reduction in production cost, for example.

In the crosslinked polyacrylic acid polymer, a percentage of carboxyl-group-containing structural units relative to the total moles of all the structural units included in the molecular chain is preferably greater than or equal to 50 mol %, more preferably greater than or equal to 80 mol %, and even more preferably greater than or equal to 90 mol %. If the percentage of the carboxyl-group-containing structural units is too low, it may be difficult to ensure a sufficiently good ink absorption characteristic.

It is preferable that some of the carboxyl groups in the crosslinked polyacrylic acid polymer be neutralized and form a salt. In the crosslinked polyacrylic acid polymer, a percentage of neutralized carboxyl groups relative to the total moles of all the carboxyl groups is preferably 30 mol % or greater and 99 mol % or less, more preferably 50 mol % or greater and 99 mol % or less, and even more preferably 70 mol % or greater and 99 mol % or less.

Furthermore, the liquid-absorbent resin 4 may include a crosslinked structure formed with a crosslinking agent other than the polymerizable crosslinking agent mentioned above.

When the liquid-absorbent resin 4 is a resin containing acid groups, it is preferable that the crosslinking agent be, for example, a compound containing acid groups and functional groups that are reactive with acid groups. When the liquid-absorbent resin 4 is a resin containing acid groups and functional groups that are reactive with acid groups, it is preferable that the crosslinking agent be a compound containing, in the molecule, functional groups that are reactive with acid groups.

Examples of the crosslinking agent containing acid groups and functional groups that are reactive with acid groups include glycidyl ether compounds, such as ethylene glycol diglycidyl ether, trimethylolpropane triglycidyl ether, (poly)glycerol polyglycidyl ether, diglycerol polyglycidyl ether, and propylene glycol diglycidyl ether; polyhydric alcohols, such as (poly)glycerol, (poly)ethylene glycol, propylene glycol, 1,3-propanediol, polyoxyethylene glycol, triethylene glycol, tetraethylene glycol, diethanolamine, and triethanolamine; and polyamines and the like, such as ethylenediamine, diethylenediamine, polyethyleneimine, and hexamethylene diamine. Other preferred examples include ions of a multivalent metal, such as zinc, calcium, magnesium, or aluminum. Such ions serve as a crosslinking agent by reacting with acid groups present in the liquid-absorbent resin 4.

The particles of the liquid-absorbent resin 4 may have any shape, such as flaky, acicular, fibrous, or substantially spherical or equiaxed, but it is preferable that most of the particles have a substantially spherical or equiaxed shape. When most of the particles of the liquid-absorbent resin 4 have a substantially spherical or equiaxed shape, ink penetration characteristics can be easily ensured. In addition, the particles of the liquid-absorbent resin 4 can be suitably supported on the fiber. Note that the phrase "substantially spherical or equiaxed shape" refers to a shape having an aspect ratio of 0.3 or greater and 1.0 or less. The aspect ratio is the ratio of a minimum length to a maximum length of the particle. An average particle diameter of the particles is preferably 15 μm or greater and 800 μm or less, more preferably 15 μm or greater and 400 μm or less, and even more preferably 15 μm or greater and 50 μm or less.

Note that the average particle diameter of the particles may be, for example, a mean volume diameter MVD, which is a volume-based mean particle diameter measured with a laser diffraction particle diameter distribution analyzer. Particle diameter distribution analyzers using the laser diffraction light scattering method as the measurement principle, that is, laser diffraction particle diameter distribution analyzers, can measure particle diameter distributions based on volume.

Preferably, a relationship of $0.15 \leq L/D \leq 467$ is satisfied, more preferably, a relationship of $0.25 \leq L/D \leq 333$ is satisfied, and even more preferably, a relationship of $2 \leq L/D \leq 200$ is satisfied, where D is the average particle diameter [μm] of the liquid-absorbent resin 4, and L is the average length [μm] of the individual fibers.

In the liquid absorption member 10, a content of the liquid-absorbent resin 4 is preferably 25 wt. % or greater and 300 wt. % or less and more preferably 50 wt. % or greater and 150 wt. % or less, relative to the weight of the fiber. With such a content, a sufficient ink absorption characteristic and ink penetration characteristic are ensured in the liquid absorption member 10.

If the content of the liquid-absorbent resin 4 is less than 25 wt. % relative to the weight of the fiber, the liquid absorption characteristics may be insufficient. On the other hand, if the content of the liquid-absorbent resin 4 is greater than 300 wt. % relative to the weight of the fiber, the liquid absorption member 10 may tend to swell when the liquid absorption member 10 absorbs ink, and as a result, the penetration characteristics may be reduced.

1.1.3. Adhesive

The adhesive 6 bonds the liquid-absorbent resin 4 to the substrate 5. Accordingly, the ability of the substrate 5 to support the liquid-absorbent resin 4 is enhanced, which makes it unlikely that the liquid-absorbent resin 4 will fall off the substrate 5. Note that the liquid absorption member 10 may not include the adhesive 6.

Examples of the adhesive 6 include water-soluble adhesives and organic adhesives. In particular, a water-soluble adhesive is preferable. In instances in which an aqueous ink is used, even if a water-soluble adhesive adheres to a surface of the liquid-absorbent resin 4, the water-soluble adhesive dissolves when the ink comes into contact with the water-soluble adhesive. Thus, it is possible to prevent the absorption of ink performed by the liquid-absorbent resin 4 from being interfered with by the adhesive 6.

Example of the water-soluble adhesive include proteins, such as casein, soy protein, and synthetic protein; various starches, such as starch and oxidized starch; polyvinyl alcohols, which include polyvinyl alcohol and modified polyvinyl alcohols, such as cationic polyvinyl alcohols and silyl-modified polyvinyl alcohols; cellulose derivatives, such as carboxymethyl cellulose and methylcellulose; aqueous polyurethane resins; and aqueous polyester resins. In particular, a polyvinyl alcohol is preferable in terms of bonding force. With a polyvinyl alcohol, the bonding force between the substrate 5 and the liquid-absorbent resin 4 is sufficiently enhanced.

In the liquid absorption member 10, a content of the adhesive 6 is preferably 1.0 wt. % or greater and 70 wt. % or less and more preferably 2.5 wt. % or greater and 50 wt. % or less, relative to the weight of the fiber. If the content of the adhesive 6 is less than 1.0 wt. % relative to the weight of the fiber, it is impossible to sufficiently produce an effect of the presence of the adhesive 6. On the other hand, if the content of the adhesive 6 is too high, no further significant improvement in the ability to support the liquid-absorbent resin 4 can be achieved.

Note that the liquid absorption member 10 may include one or more other materials, in addition to the fiber, the liquid-absorbent resin 4, and the adhesive 6. Examples of the one or more other materials include surfactants, lubricants, defoamers, fillers, anti-blocking agents, UV absorbers, colorants, such as pigments and dyes, flame retardants, and flow improvers.

1.2. Case

As illustrated in FIG. 1, the liquid absorption member 10 is stored in the case 20. The case 20 includes a bottom portion 22 and four sidewall portions 24, for example. The bottom portion 22 has a quadrilateral plan-view shape, and the sidewall portions 24 are disposed along the respective sides of the bottom portion 22, for example. The case 20 has a shape that has an open upper end. Note that the plan-view shape of the bottom portion 22 is not limited to a quadrilateral shape and may be, for example, a circular shape.

A ratio V2:V1, where V1 is the volume of the case 20, and V2 is the total volume of the liquid absorption member 10 prior to absorption of ink, is 0.1 or greater and 0.7 or less, for example, and preferably 0.2 or greater and 0.7 or less.

It is preferable that the case 20 have a degree of shape retainability such that the volume V1 does not change by 10% or greater when an internal pressure or an external force acts on the case 20. With such a degree of shape retainability, the case 20 can maintain its shape even when the liquid absorption member 10 absorbs ink and swells and thereby causes the case 20 to receive a force from the liquid absorption member 10. As a result, the installation state of the case 20 is stabilized, and consequently the liquid absorption member 10 can absorb ink in a consistent manner.

For example, a material of the case 20 is a resin material, such as a cyclic polyolefin or a polycarbonate, or a metal material, such as aluminum or stainless steel.

1.3. Cover

The cover 30 closes an opening 26 of the case 20. The cover 30 covers the liquid absorption member 10. The liquid absorption member 10 is held between the cover 30 and the bottom portion 22 of the case 20. A thickness of the cover 30 is preferably 50 μm or greater and 5 mm or less and more preferably 100 μm or greater and 3 mm or less. In the example illustrated in FIG. 2, the plan-view shape of the cover 30 is rectangular, but the plan-view shape is not particularly limited.

The cover 30 includes a recessed portion 32 and a peripheral portion 34. The recessed portion 32 is recessed toward the liquid absorption member 10. The peripheral portion 34 is disposed around the recessed portion 32 in plan view. The recessed portion 32 is disposed at a location to which ink is to be discharged. For example, the recessed portion 32 is disposed at a location that includes a center of the cover 30 in plan view.

The recessed portion 32 includes a bottom portion 32*a* and sidewall portions 32*b*. In the illustrated example, the bottom portion 32*a* has a quadrilateral plan-view shape. The sidewall portions 32*b* are disposed along the respective sides of the bottom portion 32*a*. At the location of the cover 30 to which ink is to be discharged, the sidewall portions 32*b* are disposed to surround at least a portion of the location. The sidewall portions 32*b* are coupled to the bottom portion 32*a*. When ink is to be discharged from the tube 506, the tube 506 is inserted into the space defined by the recessed portion 32 to discharge the ink, as illustrated in FIG. 1. The recessed portion 32 prevents ink from spilling to the outside during the discharging of the ink, which may otherwise occur due to formation of bubbles. In particular, matte black inks and the like have a high surfactant content and are therefore susceptible to bubble formation.

The peripheral portion 34 is the portion of the cover 30 other than the recessed portion 32. In the example illustrated in FIG. 2, the peripheral portion 34 is disposed to surround the recessed portion 32 in plan view. A thickness of a portion of the liquid absorption member 10 located between the peripheral portion 34 and the bottom portion 22 is greater than a thickness of a portion of the liquid absorption member 10 located between the recessed portion 32 and the bottom portion 22.

Through-holes 36 are disposed in the cover 30. Ink can pass through the through-holes 36. The through-holes 36 extend through the cover 30 in a thickness direction thereof. The cover 30 includes a surface 30*a* and a surface 30*b*. The surface 30*a* is in contact with the liquid absorption member 10. The surface 30*b* is located opposite to the surface 30*a*. The through-holes 36 extend from openings 36*a* to openings 36*b*. The openings 36*a* are disposed in the surface 30*a*, and the openings 36*b* are disposed in the surface 30*b*. In the example illustrated in FIG. 2, the openings 36*a* and the openings 36*b* are identical with each other in shape and size. Some or all of the through-holes 36 are disposed in a location of the cover 30 to which ink is to be discharged.

Some or all of the through-holes 36 are disposed in the recessed portion 32. In the illustrated example, the through-holes 36 are disposed in the bottom portion 32*a*, the sidewall portions 32*b*, and the peripheral portion 34. The through-holes 36 have a quadrilateral shape, for example. In the illustrated example, the through-holes 36 have a square shape. Note that the through-holes 36 may have a shape other than a square shape, and the shape may be a polygonal shape, such as rectangular, triangular, pentagonal, or hexagonal or may be a circular shape, an elliptical shape, or a star shape, such as a six-pointed star shape.

The through-holes 36 are a plurality of through-holes 36. The number of the through-holes 36 is not particularly limited. In the example illustrated in FIG. 2, the through-holes 36 are arranged in a matrix, in a first direction and in a second direction. The second direction is orthogonal to the first direction.

A maximum length of the openings 36*a* of the through-holes 36 is preferably 0.67 mm or greater and 8.01 mm or less, more preferably 0.80 mm or greater and 6.0 mm or less, and even more preferably 1.0 mm or greater and 4.0 mm or less. If the maximum length of the openings 36*a* is less than 0.67 mm, forming of the cover 30 is difficult. If the maximum length of the openings 36*a* is greater than 8.01 mm, the small pieces 2 may pass through the through-holes 36. Note that when a shape of the openings 36*a* is a quadrilateral shape, the maximum length of the openings 36*a* is the length of a diagonal of the quadrilateral; when the shape is a circular shape, the maximum length is a diameter of the circle; and when the shape is an elliptical shape, the maximum length is the length of a major axis of the ellipse.

An area of the openings 36*a* is preferably 0.18 $mm^2$ or greater and 64 $mm^2$ or less, more preferably 0.40 $mm^2$ or greater and 36 $mm^2$ or less, and even more preferably 0.6 $mm^2$ or greater and 16 $mm^2$ or less. If the area of the openings 36*a* is less than 0.18 $mm^2$, forming of the cover 30 is difficult. If the area of the openings 36*a* is greater than 64 $mm^2$, the small pieces 2 may pass through the through-holes 36.

An open area fraction of the cover 30 is preferably 0.08% or greater and 95% or less and more preferably 2.19% or greater and 80% or less. If the open area fraction of the cover 30 is less than 0.08%, when ink has been absorbed by the liquid absorption member 10, it is difficult for liquid in the ink to evaporate through the through-holes 36. If the open area fraction of the cover 30 is greater than 95%, the cover 30 has a significantly reduced strength. Note that the open area fraction of the cover 30 is determined according to $(S2/(S1+S2))\times 100$, where S1 is an area of the surface 30*a*, and S2 is a total area of the openings 36*a*.

Although not illustrated, in a configuration in which the through-holes 36 are disposed exclusively in the bottom portion 32*a* of the recessed portion 32, the open area fraction of the cover 30 is, for example, 0.08% or greater and 7.4% or less. Furthermore, in a configuration in which the through-holes 36 are disposed exclusively in the bottom portion 32*a* and the sidewall portions 32*b* of the recessed portion 32, the open area fraction of the cover 30 is, for example, 2.19% or greater and 22.2% or less.

In the illustrated example, the recessed portion 32 does not have a tapered shape in which a distance between sidewall portions 32*b* gradually decreases as a depth of the recessed portion 32 increases, that is, the distance between sidewall portions 32*b* is uniform along the depth. Thus, the bottom portion 32*a* is large in size, and the number of through-holes 36 is large, compared with a configuration in which the recessed portion 32 has a tapered shape in which a distance between sidewall portions 32*b* gradually decreases as a depth of the recessed portion 32 increases. Accordingly, a large amount of ink can be pass through the through-holes 36.

Examples of a material of the cover 30 include resin materials, such as polypropylene (PP), polystyrene (PS), polyethylene (PE), polyurethane (PU), polyvinyl chloride (PVC), acrylonitrile butadiene styrene (ABS), polymethylmethacrylate (PMMA), acrylonitrile styrene (AS), modified polyphenylene ether (PPE), polycarbonate (PC), polyamide (PA), polybutylene terephthalate (PBT), polyethylene terephthalate (PET), polyphenylene sulfide (PPS), polysulfone (PSU), polyacetal (POM), nylon, polyetheretherketone (PEEK), tetrafluoroethylene-perfluoroalkyl vinyl ether copolymers (PFA), tetrafluoroethylene-ethylene copolymers (ETFE), and polytetrafluoroethylene (PTFE).

Note that the cover 30 may be a metal mesh member formed of a stainless steel wire, an iron wire, a copper wire, or the like, or a perforated member.

Furthermore, the surface 30*a*, the surface 30*b*, and the inner surfaces of the through-holes 36 of the cover 30 may be hydrophobic-treated surfaces. Hydrophobic-treated surfaces prevent ink from accumulating on the cover 30.

Furthermore, some or all of the through-holes 36 may be different from one another in size. Although not illustrated, for example, the opening 36*a* of a through-hole 36 located within 10 mm in radius of a location onto which ink is dropped from the tube 506 may have a maximum length of 3.0 mm, and the opening 36*a* of a through-hole 36 located more than 10 mm in radius from the location of an end of the tube 506 may have a maximum length of 0.8 mm. This configuration enables ink discharged from the tube 506 to easily pass through a through-hole 36 disposed near the location onto which the ink is dropped and consequently prevents the ink from accumulating on the cover 30.

Furthermore, some or all of the through-holes 36 may be different from one another in shape. For example, the opening 36*a* of a through-hole 36 located within 10 mm in radius of a location onto which ink is dropped from the tube 506 may have a square shape, and the opening 36*a* of a through-hole 36 located more than 10 mm in radius from the location of an end of the tube 506 may have a circular shape. This enables ink discharged from the tube 506 to easily pass through a through-hole 36 disposed near the location onto which the ink is dropped, because a square has a larger area than a circle when their maximum lengths are equal to each other. Consequently, the ink is prevented from accumulating on the cover 30.

1.4. Liquid Absorber

The liquid absorber 100 has the following features, for example.

The liquid absorber 100 includes the liquid absorption member 10 that absorbs ink, the case 20 in which the liquid absorption member 10 is stored, and the cover 30 that covers the liquid absorption member 10. The liquid absorption member 10 includes a fiber and a liquid-absorbent resin. The cover 30 includes the through-holes 36, and ink can pass through the through-holes 36. The cover 30 includes the recessed portion 32 at a location to which ink is to be discharged. The recessed portion 32 is recessed toward the liquid absorption member 10. The through-holes 36 are disposed at least in the recessed portion 32.

Accordingly, in the liquid absorber 100, a shape of the recessed portion 32 is provided for preventing ink from spilling to the outside during the discharging of the ink, which may otherwise occur due to formation of bubbles, and the shape is maintained when, for example, the liquid absorber 100 is transferred. In addition, uneven distribution of the individual fibers of the liquid absorption member 10 is unlikely to occur compared with a configuration in which no cover is provided, and, therefore, good absorption characteristics are achieved. In addition, when ink has been absorbed by the liquid absorption member 10, liquid in the ink can evaporate through the through-holes 36, and, therefore, the absorbed ink easily dries. In addition, even when the liquid absorption member 10 emits dust, the cover 30 prevents the dust from rising up.

In addition, the liquid absorption member 10 has a reduced bulk density compared with a liquid absorption member formed by fusing together individual fibers with a fused resin, such as a thermoplastic resin, and, therefore, the liquid absorption member 10 has excellent absorption characteristics with respect to ink. Specifically, a large area of contact between ink and the fiber is ensured, and, therefore, the fiber can hold the ink temporarily. Subsequently, the ink can be delivered from the fiber to the liquid-absorbent resin 4. Accordingly, the liquid absorption member 10 has excellent absorption characteristics with respect to ink.

In addition, the liquid absorption member 10 has improved conformability to the shape of the case 20 compared with a liquid absorption member formed by fusing together individual fibers with a fused resin. Hence, the liquid absorption member 10 is highly versatile, and the production cost can be reduced.

In the liquid absorber 100, the recessed portion 32 includes the bottom portion 32*a* and the sidewall portions 32*b*, and some of the through-holes 36 are disposed in the bottom portion 32*a*. Accordingly, in the liquid absorber 100, discharged ink can be reliably brought into contact with the liquid absorption member 10.

In the liquid absorber 100, some of the through-holes 36 are disposed in the sidewall portions 32*b*. Accordingly, in the liquid absorber 100, even if dried ink clogs the through-holes 36 disposed in the bottom portion 32*a*, ink can be passed through the through-holes 36 disposed in the sidewall portions 32*b*.

In the liquid absorber 100, a maximum length of the openings 36*a* of the through-holes 36 is 0.67 mm or greater and 8.01 mm or less, and an area of the openings 36*a* of the through-holes 36 is 0.18 $mm^2$ or greater and 64 $mm^2$ or less. This configuration of the liquid absorber 100 prevents the small pieces 2 from passing through the through-holes 36 and facilitates the forming of the cover 30.

In the liquid absorber 100, the open area fraction of the cover 30 is preferably 0.08% or greater and 95% or less and more preferably 2.19% or greater and 80% or less. This configuration of the liquid absorber 100 ensures a strength of the cover 30 and increases the amount of ink that can be absorbed because, when ink has been absorbed by the liquid absorption member 10, liquid in the ink can evaporate through the through-holes 36.

In the liquid absorber 100, the individual fibers constitute the substrates 5, and the liquid-absorbent resin 4 is supported on the substrates 5. This configuration of the liquid absorber 100 reliably prevents dust emission compared with a configuration in which the individual fibers do not constitute substrates but are in an entangled state.

2. METHOD FOR PRODUCING LIQUID ABSORPTION MEMBER

A method for producing the liquid absorption member 10, according to an embodiment, will now be described with reference to the drawings. FIG. 6 to FIG. 9 are diagrams illustrating the method for producing the liquid absorption member 10.

Figure 6:
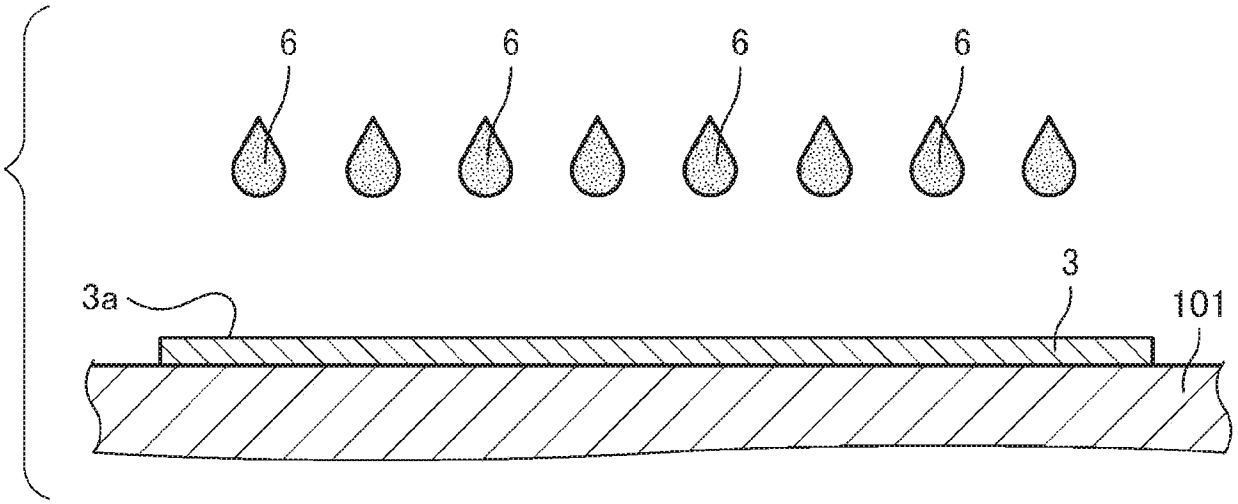
FIG. 6 is a diagram illustrating a method for producing a liquid absorption member of a liquid absorber, according to an embodiment.

As illustrated in FIG. 6, a sheet-shaped sheet member 3 (e.g., waste paper) is laid on a bench 101.

Next, the adhesive 6, which is in a liquid form, is applied to one surface 3*a* of the sheet member 3. Examples of a method for applying the adhesive 6 include a spray method and a method in which a sponge roller is impregnated with the adhesive 6, and the sponge roller is rolled across the surface 3*a* of the sheet member 3.

Figure 7:
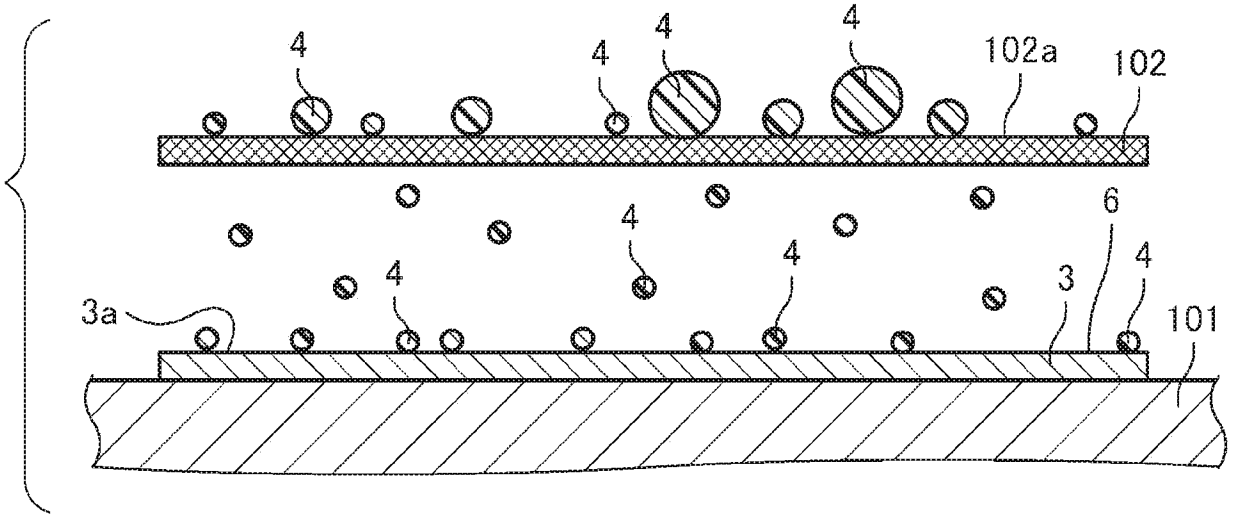
FIG. 7 is a diagram illustrating the method for producing a liquid absorption member of a liquid absorber, according to an embodiment.

As illustrated in FIG. 7, the particles of the liquid-absorbent resin 4 are applied to the surface 3*a* of the sheet member 3 through a mesh member 102. The mesh member 102 has openings 102*a*. Among the particles of the liquid-absorbent resin 4, particles larger than the openings 102*a* are retained on the mesh member 102, and particles smaller than the opening 102*a* pass through the openings 102*a* and are applied to the surface 3*a* of the sheet member 3.

Thus, the use of the mesh member 102 increases the uniformity of the particle diameters of the liquid-absorbent resin 4. Hence, variations in the absorption characteristics are prevented from occurring in different locations of the sheet member 3.

A maximum width of the openings 102*a* is preferably 0.06 mm or greater and 0.15 mm or less and more preferably 0.08 mm or greater and 0.12 mm or less. With this configuration, the particle diameters of the liquid-absorbent resin 4 applied to the sheet member 3 fall within the numerical range mentioned above.

Figure 8:
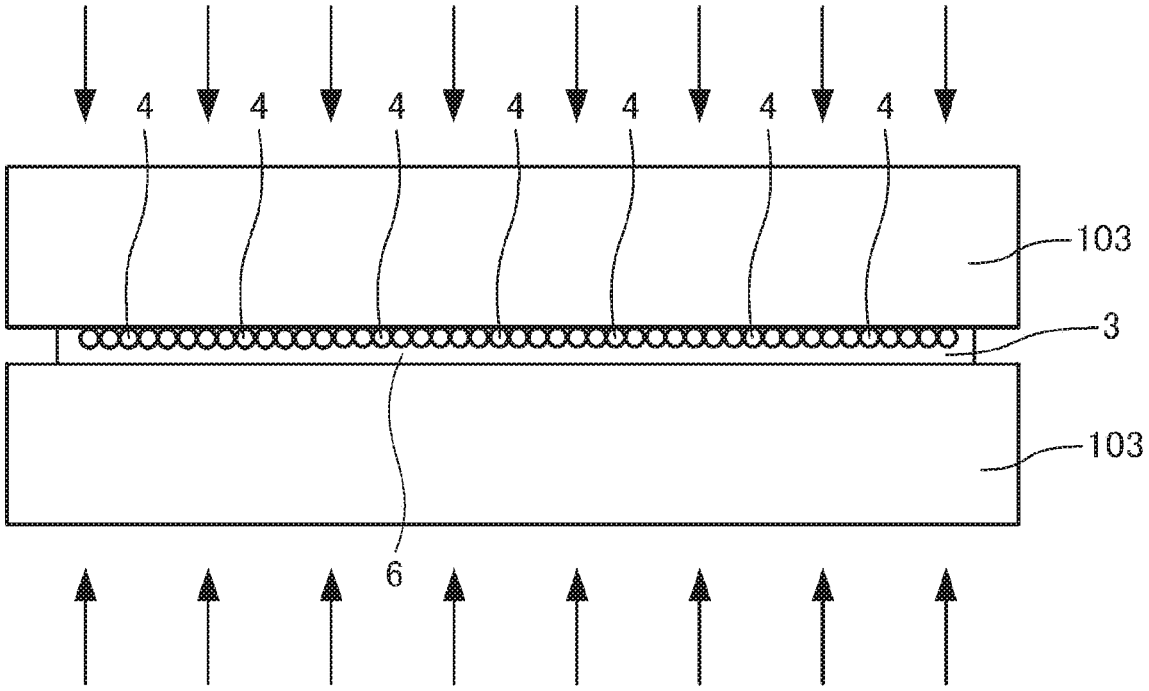
FIG. 8 is a diagram illustrating the method for producing a liquid absorption member of a liquid absorber, according to an embodiment.

As illustrated in FIG. 8, the sheet member 3, to which the particles of the liquid-absorbent resin 4 adhere, is positioned between a pair of heating blocks 103. Subsequently, the pair of heating blocks 103 is heated, and a pressure is applied in a direction in which a distance between the pair of heating blocks 103 decreases, thereby applying a pressure to the sheet member 3 in a thickness direction thereof. Accordingly, the particles of the liquid-absorbent resin 4 and the adhesive 6 are softened, and the particles of the liquid-absorbent resin 4 are embedded in the sheet member 3 as a result of the application of pressure. Subsequently, the heating and pressure application are discontinued, and accordingly, the adhesive 6 dries, and bonding is accomplished in a state in which the particles of the liquid-absorbent resin 4 are embedded in the sheet member 3.

In this step, the force of the pressure is preferably 0.1 $kg/cm^2$ or greater and 1.0 $kg/cm^2$ or less and more preferably 0.2 $kg/cm^2$ or greater and 0.8 $kg/cm^2$ or less. In this step, the heating temperature is preferably 80° C. or higher and 160° C. or lower and more preferably 100° C. or higher and 120° C. or lower.

Next, the sheet member 3 is finely cut, crushed, or ground with scissors, a cutter, a mill, a shredder, or the like or finely torn by hand, for example, thereby forming the liquid absorption member 10 including the small pieces 2. Subsequently, the liquid absorption member 10 is weighed out to a desired amount. Thereafter, the liquid absorption member 10 is, for example, loosened up by hand to adjust the bulk density and stored in the case 20.

As illustrated in FIG. 1, the cover 30 is pressed against the liquid absorption member 10 and fitted to the case 20. The cover 30 is formed by injection molding, for example.

With the steps described above, the liquid absorber 100 can be produced.

3. MODIFIED EXAMPLES OF LIQUID ABSORBER

3.1. First Modified Example

Figure 9:
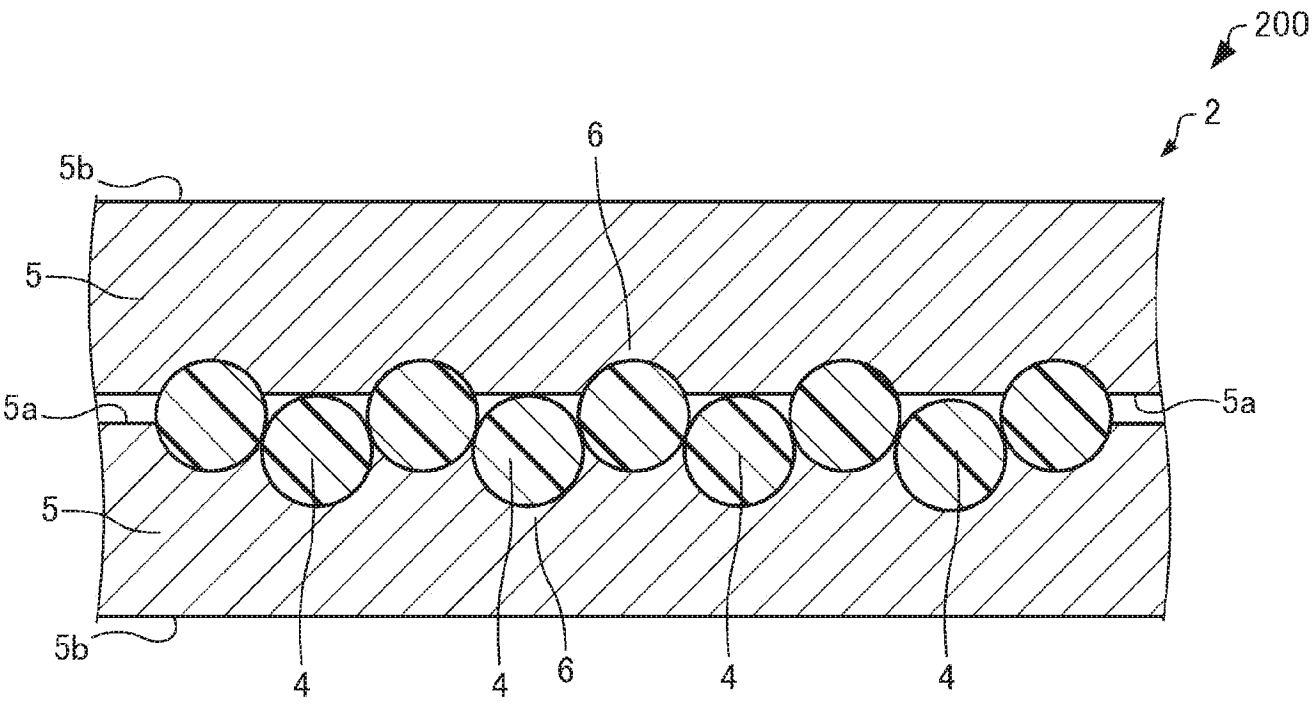
FIG. 9 is a diagram illustrating a small piece that is included in a liquid absorption member, which is loaded in a liquid absorber, according to a first modified example of an embodiment.

A liquid absorber according to a first modified example of an embodiment will now be described with reference to the drawings. FIG. 9 is a diagram illustrating a substrate 5, a liquid-absorbent resin 4, and an adhesive 6, which are included in small pieces 2 of a liquid absorber 200, according to the first modified example of the embodiment. The substrate 5 includes individual fibers.

In the following description, the liquid absorber 200 according to the first modified example of the embodiment will be described regarding features different from those of the example of the liquid absorber 100 of the above-described embodiment. Features common between the two examples will not be described. This applies to liquid absorbers of second and third modified examples of embodiments, which will be described later.

The liquid absorber 200 is different from the above-described liquid absorber 100 in that the liquid-absorbent resin 4 is held between a pair of portions of the substrate 5, as illustrated in FIG. 9.

In the liquid absorber 200, the liquid-absorbent resin 4 is held between a pair of portions of the substrate 5, and, therefore, the liquid-absorbent resin 4 is unlikely to fall off the substrates 5 compared with a configuration in which the liquid-absorbent resin 4 is not held between portions of the substrate 5. Accordingly, excellent absorption characteristics with respect to ink are exhibited over a long period of time. In addition, the particles of the liquid-absorbent resin 4 are prevented from being unevenly distributed in the case 20, and, therefore, variations in the ink absorption characteristics are prevented from occurring.

Figure 10:
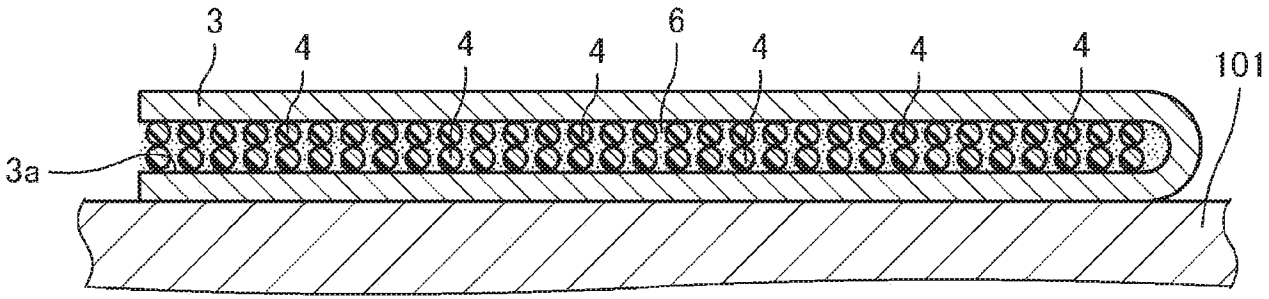
FIG. 10 is a diagram illustrating a method for producing the liquid absorption member of the liquid absorber, according to the first modified example of the embodiment.
Figure 11:
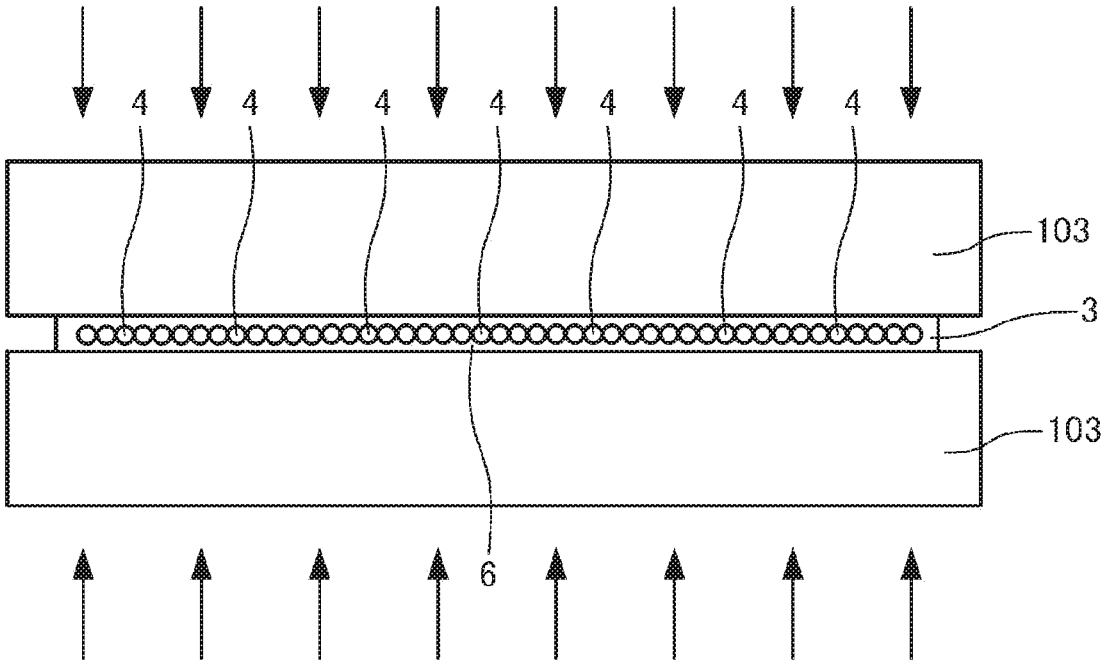
FIG. 11 is a diagram illustrating the method for producing the liquid absorption member of the liquid absorber, according to the first modified example of the embodiment.

A method for producing the liquid absorption member 10 of the liquid absorber 200 will now be described with reference to the drawings. FIG. 10 and FIG. 11 are diagrams illustrating the method for producing the liquid absorption member 10 of the liquid absorber 200.

As illustrated in FIG. 10, the particles of the liquid-absorbent resin 4 are applied to the sheet member 3 laid on the bench 101, and thereafter, the sheet member 3 is folded in a manner such that the surface 3*a*, which includes the applied particles of the liquid-absorbent resin 4, is located on the inner side.

As illustrated in FIG. 11, the folded sheet member 3 is positioned between the pair of heating blocks 103. Subsequently, the pair of heating blocks 103 is heated, and a pressure is applied in a direction in which a distance between the pair of heating blocks 103 decreases, thereby applying a pressure to the sheet member 3 in a thickness direction thereof. Accordingly, the particles of the liquid-absorbent resin 4 and the adhesive 6 are softened by the heat, and the particles of the liquid-absorbent resin 4 are embedded in the sheet member 3 as a result of the application of pressure. Furthermore, particles of the liquid-absorbent resin 4 that come into contact with one another as a result of the folding are softened and joined together.

Subsequently, the heating and pressure application are discontinued, and accordingly, the adhesive 6 dries, and bonding is accomplished in a state in which the particles of the liquid-absorbent resin 4 are embedded in the sheet member 3, and further, the folded halves of the sheet member 3, which overlap each other, are joined together with the particles of the liquid-absorbent resin 4 and the adhesive 6.

Next, the sheet member 3 is cut with a shredder or the like. The subsequent steps are basically the same as those of the above-described method for producing the liquid absorber 100.

In the method for producing the liquid absorber 200, the configuration including multilayers of the sheet member 3 is realized by the simple process, that is, by applying the liquid-absorbent resin 4 to a single sheet member 3 and folding the sheet member 3. That is, there is no need to apply the liquid-absorbent resin 4 to two sheet members 3 separately. Accordingly, the production process is simplified.

In addition, in the sheet member 3, the surface free of the liquid-absorbent resin 4 comes into contact with the heating blocks 103. Accordingly, the liquid-absorbent resin 4 is prevented from adhering to the heating blocks 103. Hence, there is no need for a step of cleaning the heating blocks 103.

3.2. Second Modified Example

Figure 12:
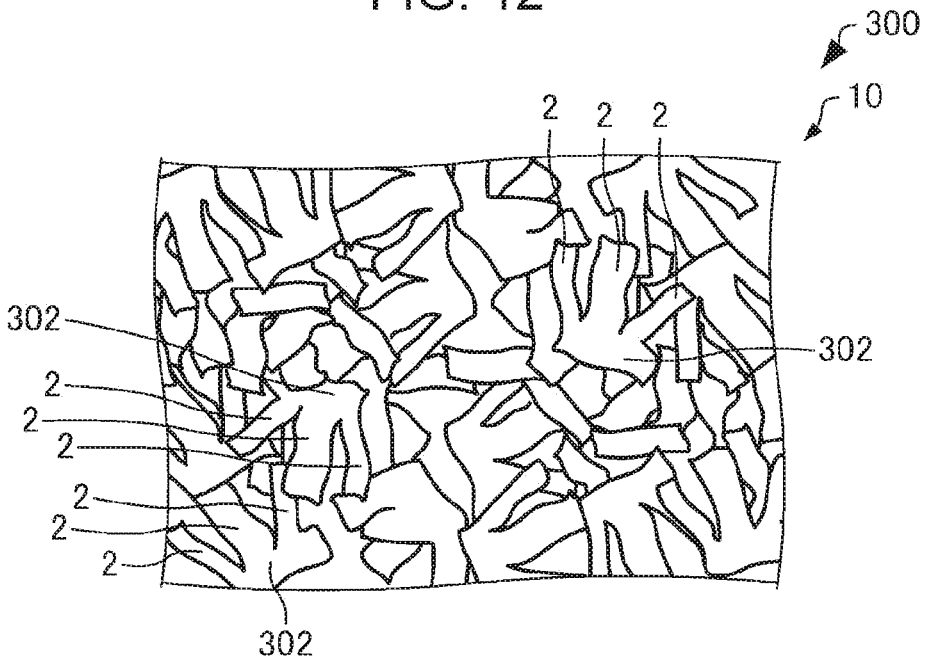
FIG. 12 is a diagram illustrating a liquid absorption member, which is loaded in a liquid absorber, according to a second modified example of an embodiment.

A liquid absorber according to a second modified example of an embodiment will now be described with reference to the drawings. FIG. 12 is a diagram illustrating an assembly of small pieces 2 included in a liquid absorber 300, according to the second modified example of the embodiment.

As illustrated in FIG. 12, the liquid absorber 300 is different from the above-described liquid absorber 100 in that a plurality of the small pieces 2 are coupled together with a coupling piece 302. With this configuration, in the process of storing the small pieces 2 in the case 20, the coupling piece 302 can be grasped, thereby collectively storing the plurality of the small pieces 2 in the case 20. Hence, the operation of storing the small pieces 2 can be carried out readily and quickly. Note that it is preferable that, as with the small pieces 2, the coupling piece 302 include the liquid-absorbent resin 4 supported thereon.

The plurality of small pieces 2 and the coupling piece 302 that couple together the plurality of small pieces 2 can be formed by, for example, making a plurality of parallel cuts in a sheet of paper such that the cuts extend from a first end of the sheet toward a second end of the sheet but do not reach the second end.

Note that the coupling piece 302 may be formed of a different member, examples of which include paper tape, staples, and other bonding members. Furthermore, in the illustrated example, the number of small pieces 2 that are coupled together via the coupling piece 302 is not particularly limited. Furthermore, the coupling piece 302 may not necessarily couple together the end portions of second ends of small pieces 2. For example, the coupling piece 302 may couple together middle portions of small pieces 2 with respect to longitudinal directions thereof.

3.3. Third Modified Example

Figure 13:
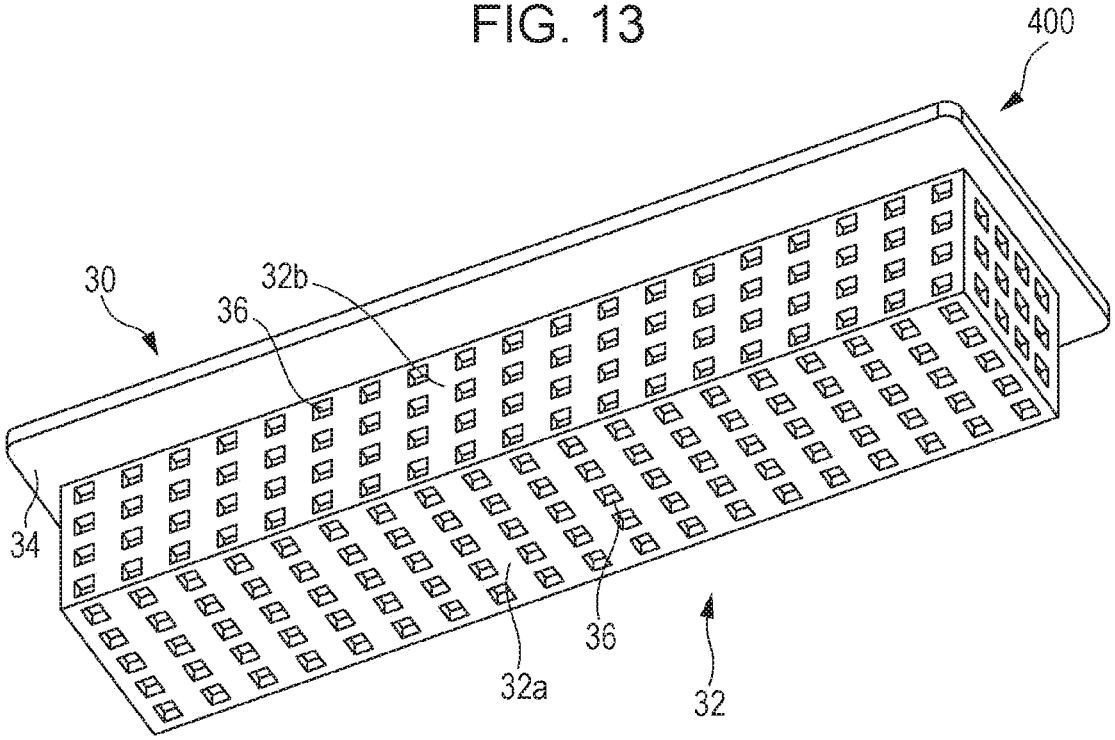
FIG. 13 is a schematic perspective view of a cover of a liquid absorber, according to a third modified example of an embodiment.
Figure 14:
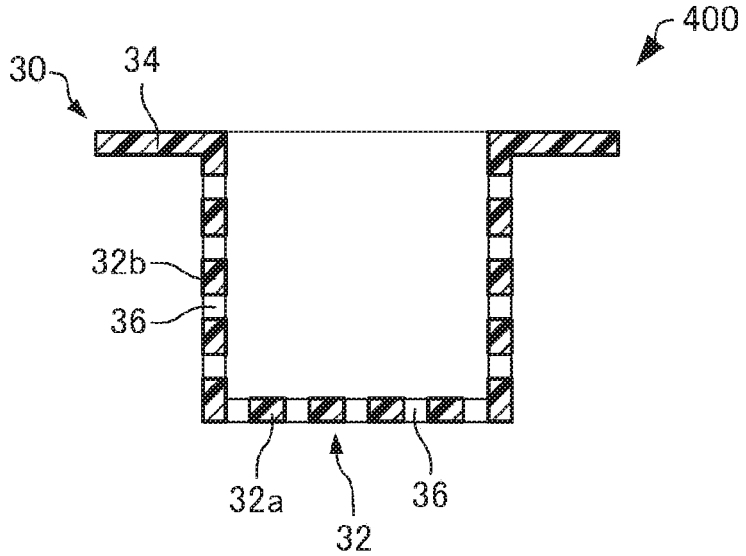
FIG. 14 is a schematic cross-sectional view of the cover of the liquid absorber, according to the third modified example of the embodiment.

A liquid absorber according to a third modified example of an embodiment will now be described with reference to the drawings. FIG. 13 is a schematic perspective view of a cover 30 of a liquid absorber 400, according to the third modified example of the embodiment. FIG. 14 is a schematic cross-sectional view of the cover 30 of the liquid absorber 400 according to the third modified example of the embodiment.

As illustrated in FIG. 13 and FIG. 14, the shape of the cover 30 of the liquid absorber 400 is different from that of the liquid absorber 100 described above.

As illustrated in FIG. 1 and FIG. 2, the cover 30 of the liquid absorber 100 includes through-holes 36 disposed in the peripheral portion 34. In contrast, the liquid absorber 400, illustrated in FIG. 13 and FIG. 14, has no through-holes 36 disposed in the peripheral portion 34. This configuration increases a strength of the cover 30.

Figure 15:
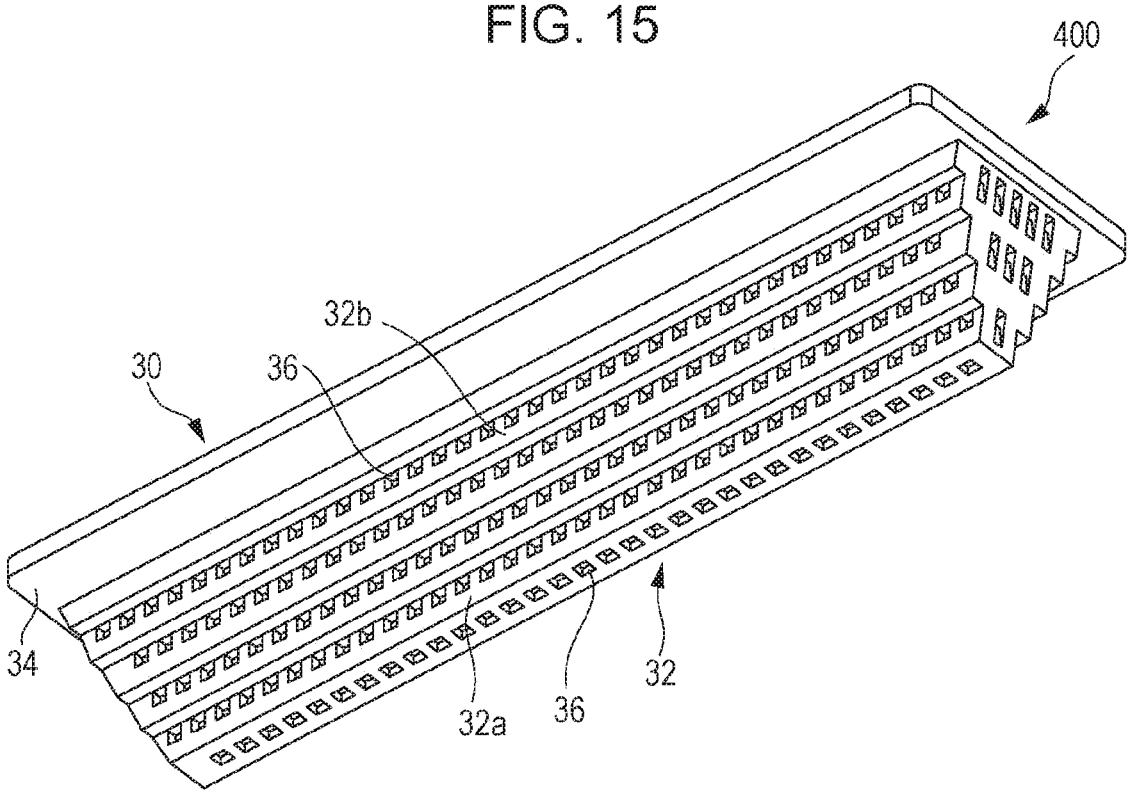
FIG. 15 is a schematic perspective view of a cover of the liquid absorber, according to the third modified example of the embodiment.
Figure 16:
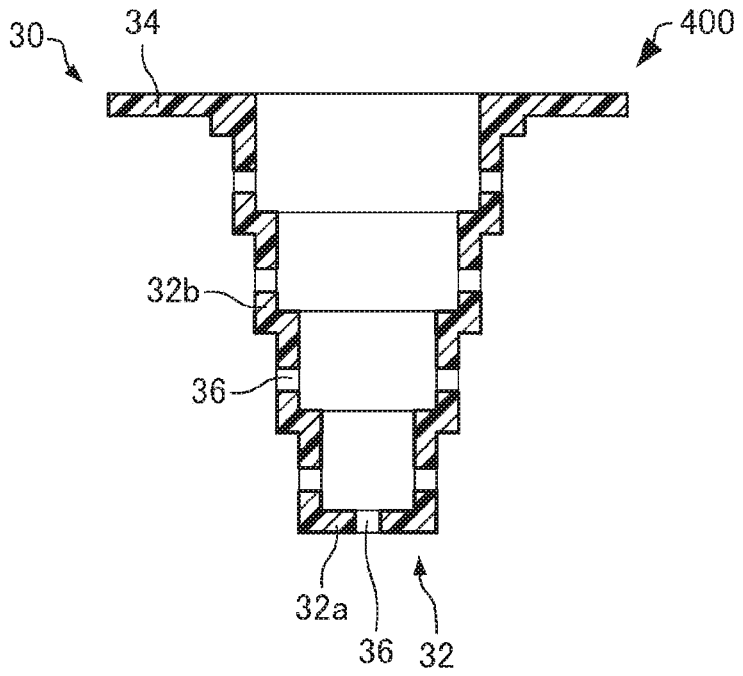
FIG. 16 is a schematic cross-sectional view of the cover of the liquid absorber, according to the third modified example of the embodiment.
Figure 17:
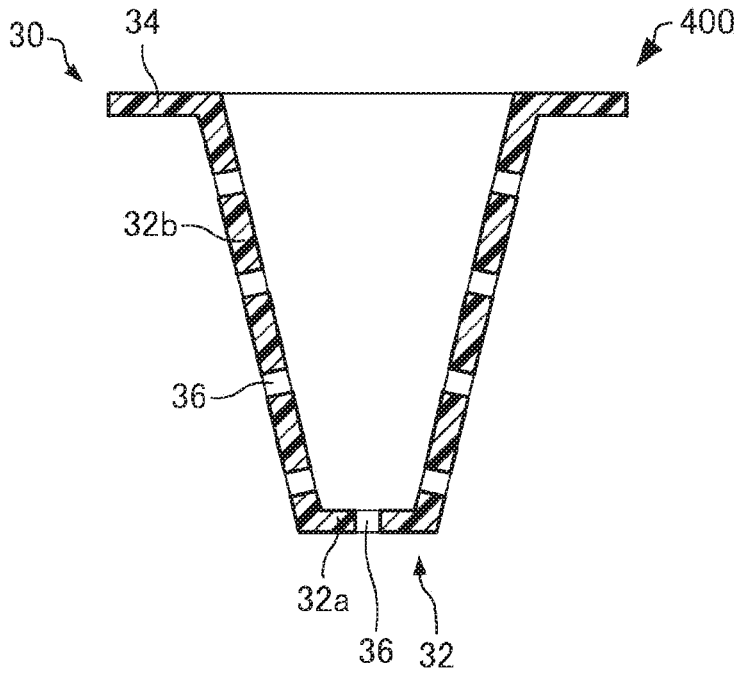
FIG. 17 is a schematic cross-sectional view of a cover of a liquid absorber, according to the third modified example of the embodiment.

Note that, as illustrated in FIG. 15 and FIG. 16, the sidewall portions 32*b* may have a stepped shape in which a distance between sidewall portions 32*b* decreases as a depth of the recessed portion 32 increases. FIG. 15 is a schematic perspective view of the cover 30, and FIG. 16 is a schematic cross-sectional view of the cover 30 illustrated in FIG. 15. Alternatively, as illustrated in FIG. 17, the recessed portion 32 may have a tapered shape in which a distance between sidewall portions 32*b* gradually decreases as a depth of the recessed portion 32 increases. FIG. 17 is a schematic cross-sectional view of the cover 30. In such a cover 30, a distance between sidewall portions 32*b* decreases as a depth of the recessed portion 32 increases, and, therefore, even when the liquid absorption member 10 swells as a result of absorption of ink, it is unlikely that a stress attributable to the swelling of the liquid absorption member 10 will act on the cover 30. Hence, damage to the cover 30 is prevented.

Figure 18:
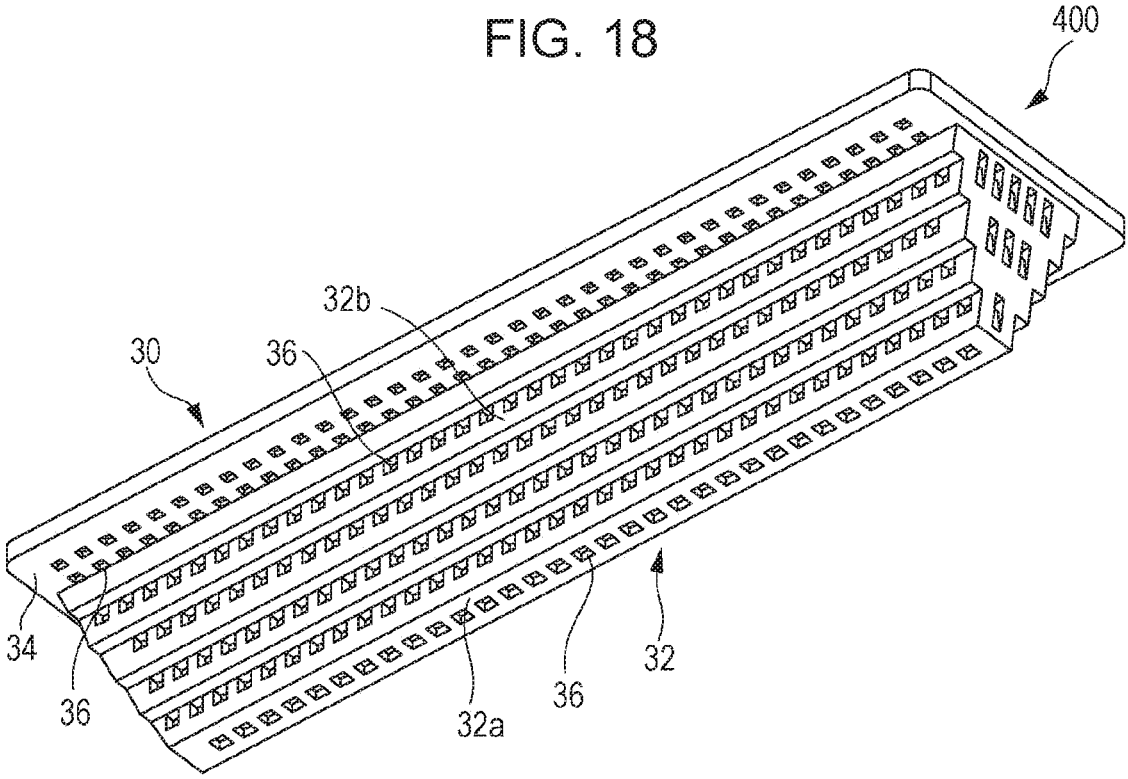
FIG. 18 is a schematic perspective view of a cover of a liquid absorber, according to the third modified example of the embodiment.
Figure 19:
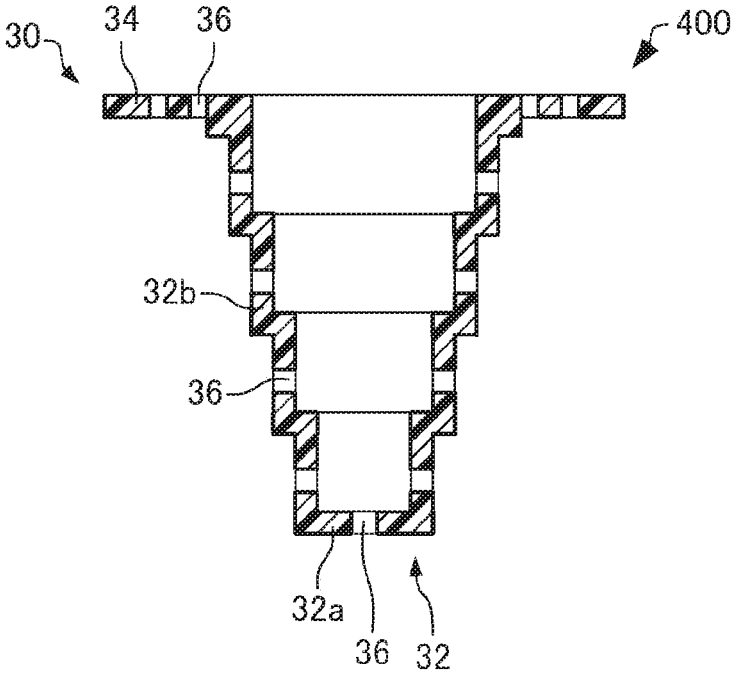
FIG. 19 is a schematic cross-sectional view of the cover of the liquid absorber, according to the third modified example of the embodiment.

In a cover 30 in which the sidewall portions 32*b* have a stepped shape, through-holes 36 may also be disposed in the peripheral portion 34, as illustrated in FIG. 18 and FIG. 19. FIG. 18 is a schematic perspective view of the cover 30, and FIG. 19 is a schematic cross-sectional view of the cover 30 illustrated in FIG. 18. With such a cover 30, the amount of ink that can be absorbed is increased compared with a configuration in which no through-holes 36 are disposed in the peripheral portion 34, because, when ink has been absorbed by the liquid absorption member 10, liquid in the ink can easily evaporate through the through-holes 36.

Figure 20:
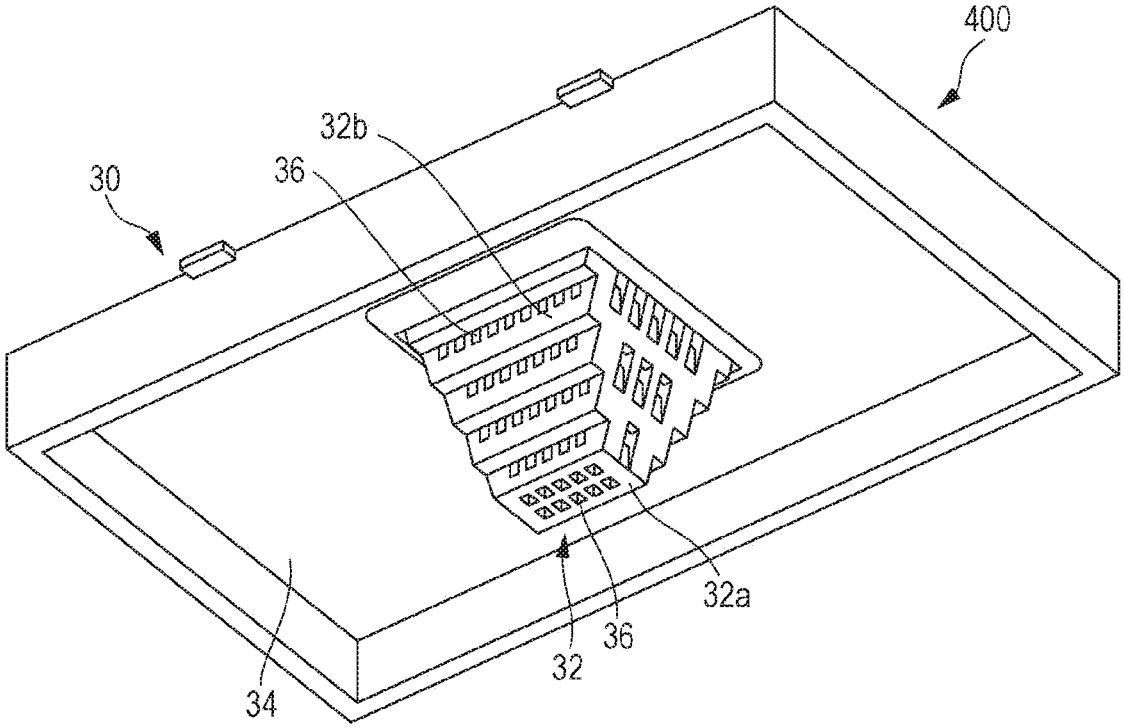
FIG. 20 is a schematic perspective view of a cover of a liquid absorber, according to the third modified example of the embodiment.

Furthermore, as illustrated in FIG. 20, an area of the recessed portion 32 may be less than half an area of the peripheral portion 34 in plan view. FIG. 20 is a schematic perspective view of a cover 30. With such a cover 30, the volume of the liquid absorption member 10 can be increased because the area of the recessed portion 32 is reduced, and consequently, the amount of ink that can be absorbed is increased. Furthermore, the recessed portion 32 may be configured to be attachable to and detachable from the peripheral portion 34.

Figure 21:
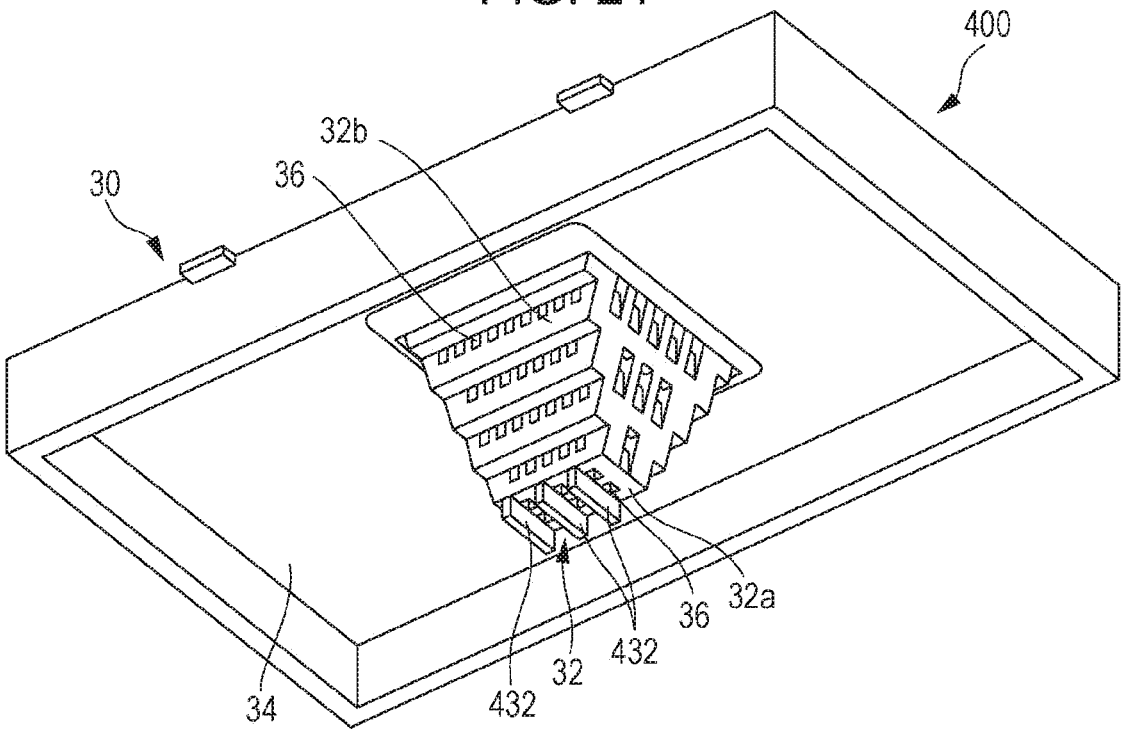
FIG. 21 is a schematic perspective view of a cover of a liquid absorber, according to the third modified example of the embodiment.
Figure 22:
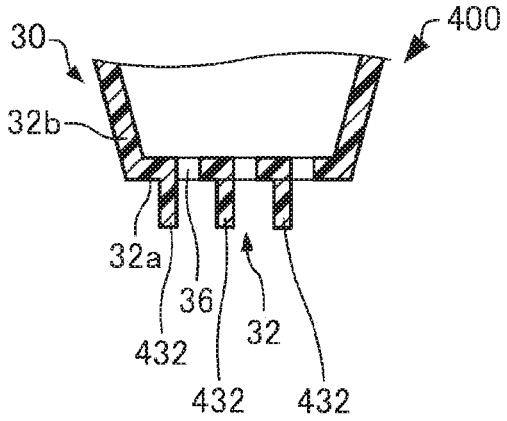
FIG. 22 is a schematic cross-sectional view of the cover of the liquid absorber, according to the third modified example of the embodiment.

Furthermore, as illustrated in FIG. 21 and FIG. 22, the bottom portion 32*a* may include protruding portions 432, which protrude toward the liquid absorption member 10. FIG. 21 is a schematic perspective view of a cover 30, and FIG. 22 is a schematic cross-sectional view of the cover 30 illustrated in FIG. 21. In such a cover 30, the protruding portions 432 prevent clogging of the through-holes 36 disposed in the bottom portion 32*a* that may be otherwise caused by the liquid absorption member 10 when the liquid absorption member 10 absorbs ink and swells. By virtue of the protruding portions 432, a gap can be formed between the through-holes 36 disposed in the bottom portion 32*a* and the swollen liquid absorption member 10. The through-holes 36 are disposed between respective adjacent protruding portions 432 in plan view. In the illustrated example, three protruding portions 432 are provided. Although not illustrated, some or all of the protruding portions 432 may be disposed on a sidewall portion 32*b*.

Figure 23:
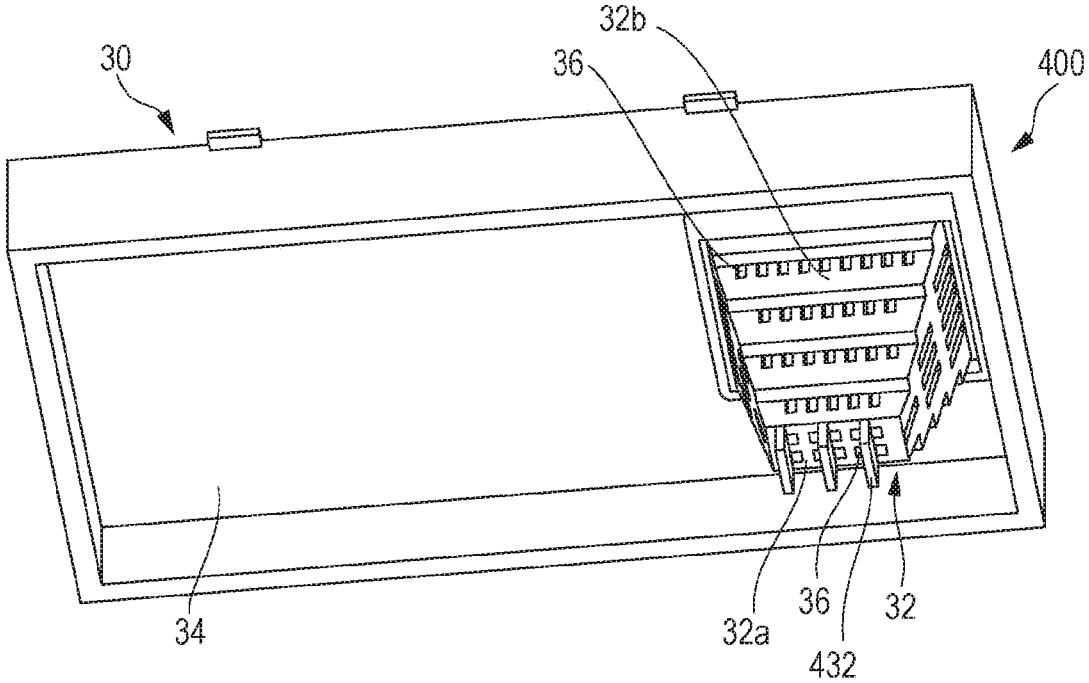
FIG. 23 is a schematic perspective view of a cover of a liquid absorber, according to the third modified example of the embodiment.
Figure 24:
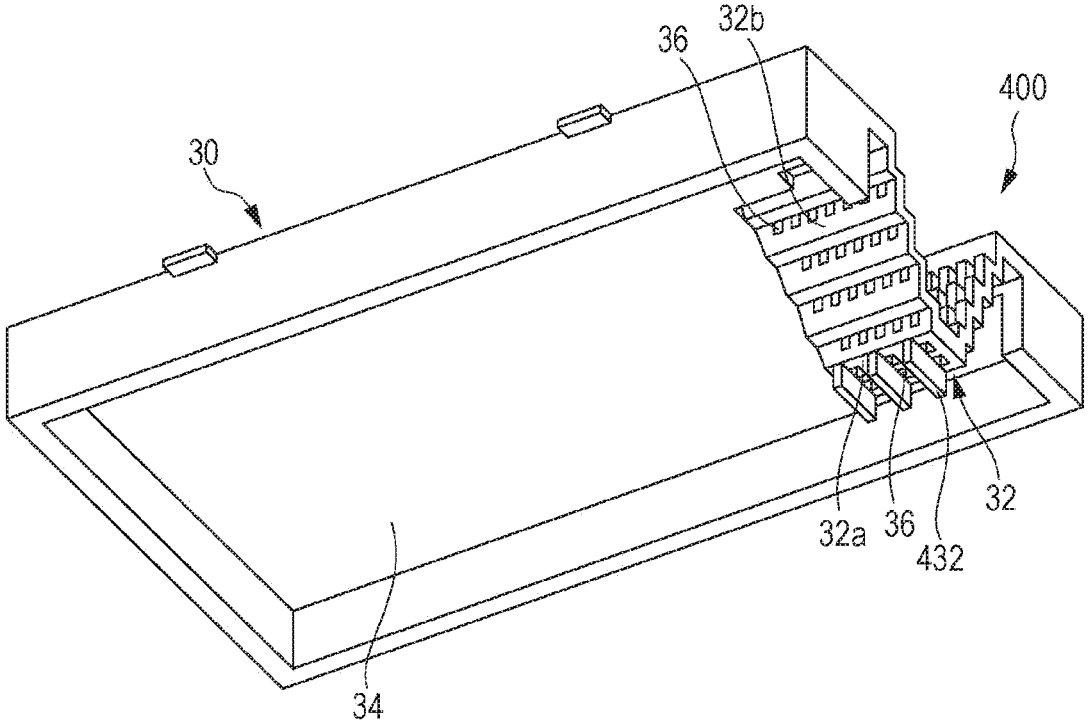
FIG. 24 is a schematic perspective view of a cover of a liquid absorber, according to the third modified example of the embodiment.
Figure 25:
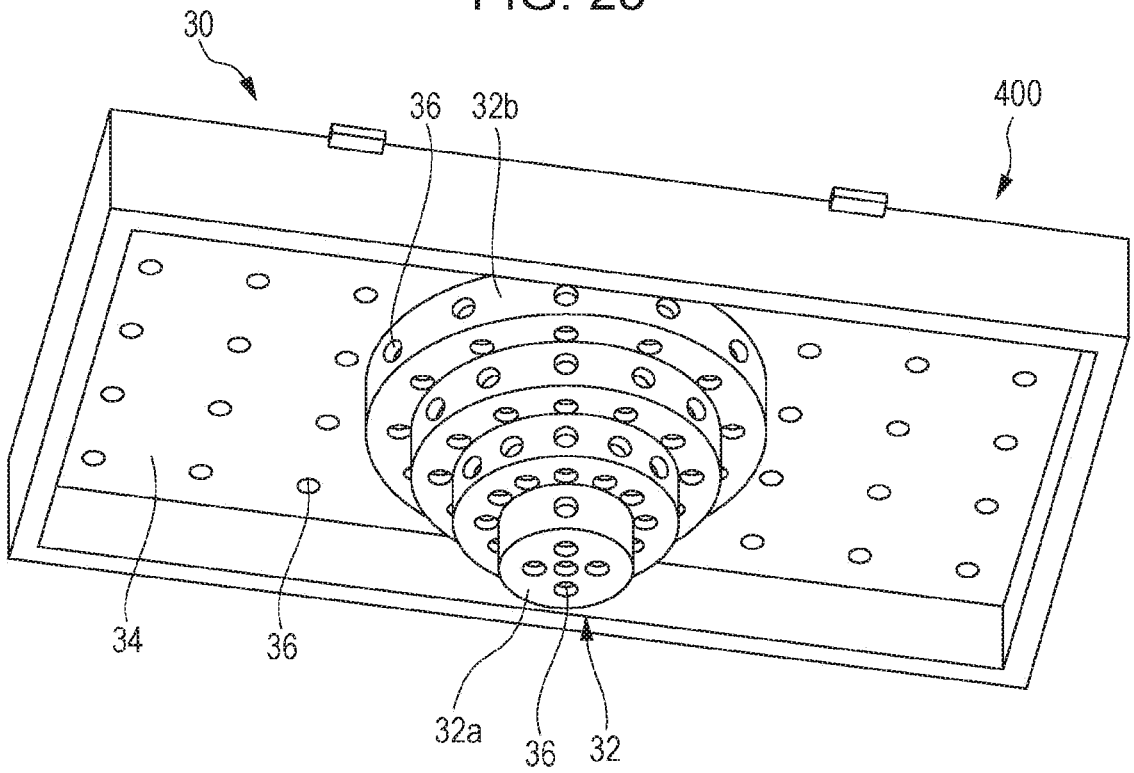
FIG. 25 is a schematic perspective view of a cover of a liquid absorber, according to the third modified example of the embodiment.

Furthermore, as illustrated in FIG. 23, the recessed portion 32 may be disposed at a location that does not include a center of the cover 30 in plan view. Furthermore, as illustrated in FIG. 24, the recessed portion 32 may be partially open. FIG. 23 and FIG. 24 are schematic perspective views of covers 30. When a cover 30 has such a configuration, the tube 506 can be positioned at a location away from a center of the cover 30 in plan view, and, therefore, replacement of the liquid absorber is easy.

Furthermore, as illustrated in FIG. 25 to FIG. 29, the bottom portion 32*a* may have a circular plan-view shape.

Figure 26:
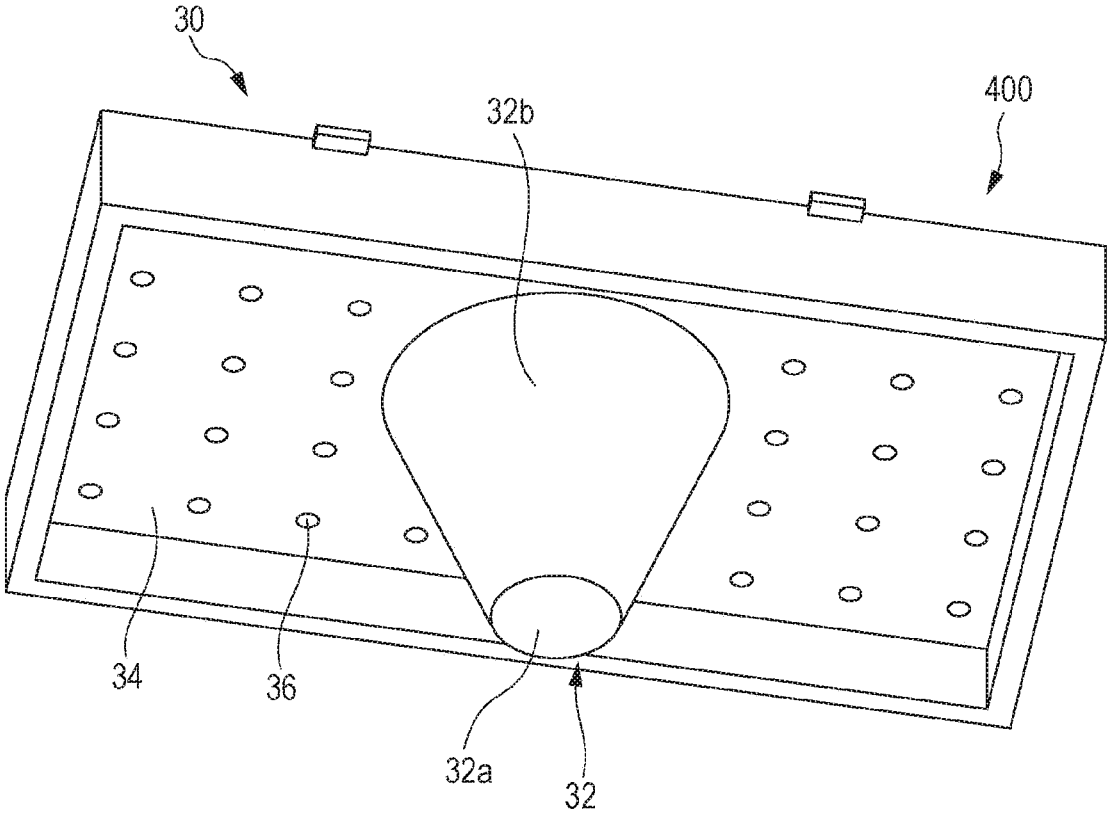
FIG. 26 is a schematic perspective view of a cover of a liquid absorber, according to the third modified example of the embodiment.
Figure 27:
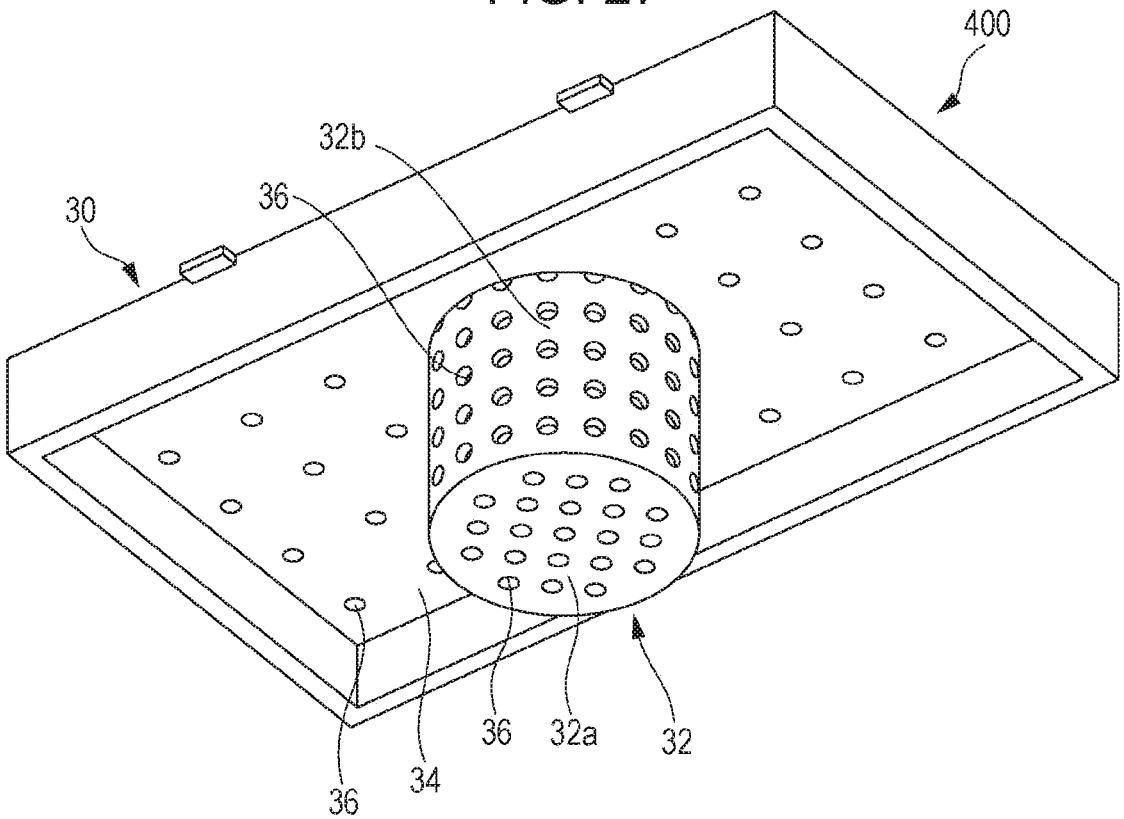
FIG. 27 is a schematic perspective view of a cover of a liquid absorber, according to the third modified example of the embodiment.
Figure 28:
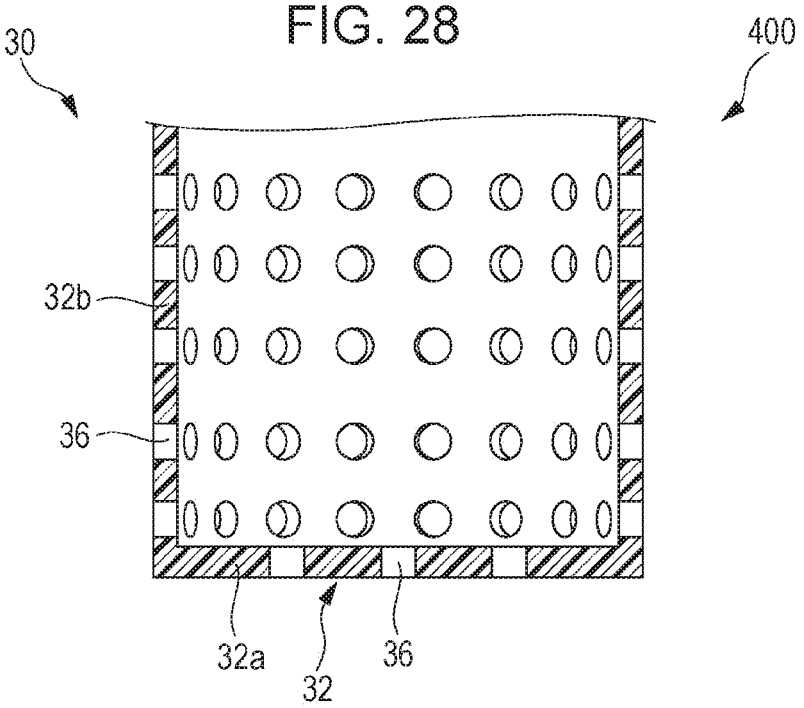
FIG. 28 is a schematic cross-sectional view of the cover of the liquid absorber, according to the third modified example of the embodiment.
Figure 29:
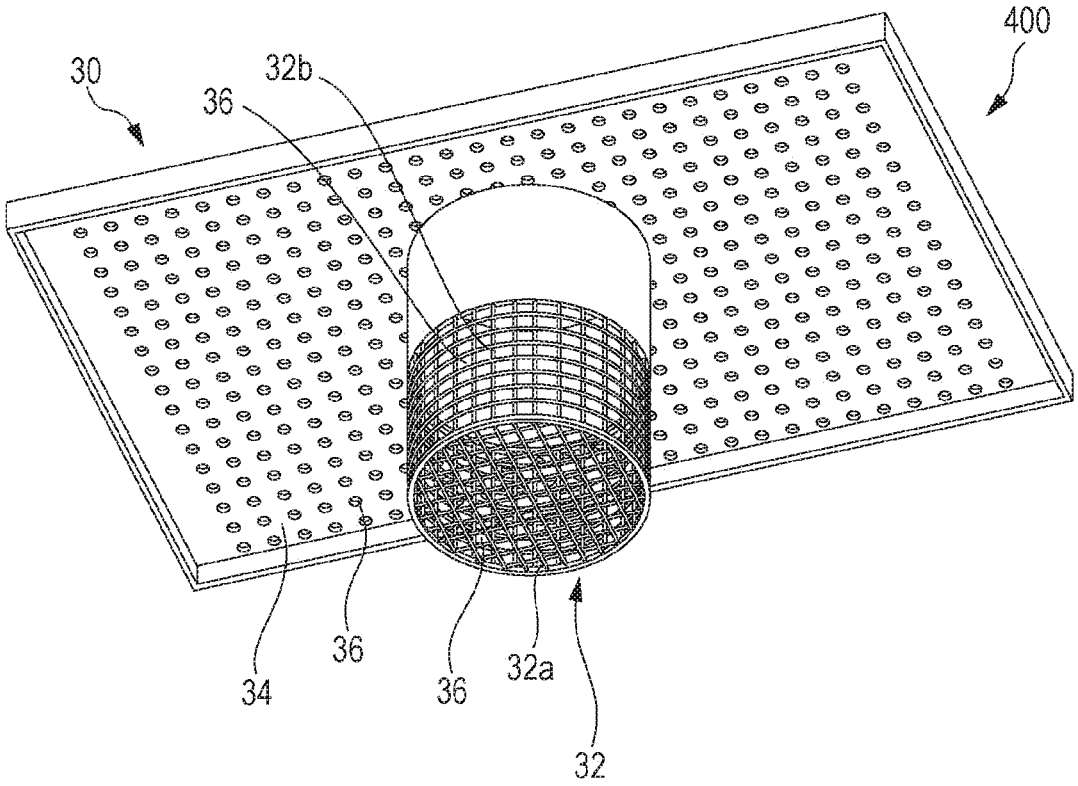
FIG. 29 is a schematic perspective view of a cover of a liquid absorber, according to the third modified example of the embodiment.

FIG. 25 to FIG. 27 and FIG. 29 are schematic perspective views of covers 30, and FIG. 28 is a schematic cross-sectional view of the cover 30 illustrated in FIG. 27. When a cover 30 has such a configuration, that is, a configuration in which the bottom portion 32*a* has a circular plan-view shape, ink can spread in a radial manner to be absorbed, and, therefore, the liquid absorption member 10 can be effectively used. The sidewall portions 32*b* of the cover 30 illustrated in FIG. 25 have a stepped shape. The recessed portion 32 of the cover 30 illustrated in FIG. 26 has a tapered shape. The recessed portion 32 of the cover 30 illustrated in FIG. 27 has a cylindrical shape. The recessed portions 32 of the covers 30 illustrated in FIG. 26 to FIG. 28 are formed of a mesh member or a perforated member. Furthermore, when a portion of the recessed portion 32 is formed of a mesh member as illustrated in FIG. 29, the open area fraction of the cover 30 is increased, and, therefore, a large amount of ink can be passed through the cover 30. Note that the through-holes 36 disposed in the bottom portion 32*a* and the sidewall portions 32*b* are omitted in FIG. 29 for convenience.

Figure 30:
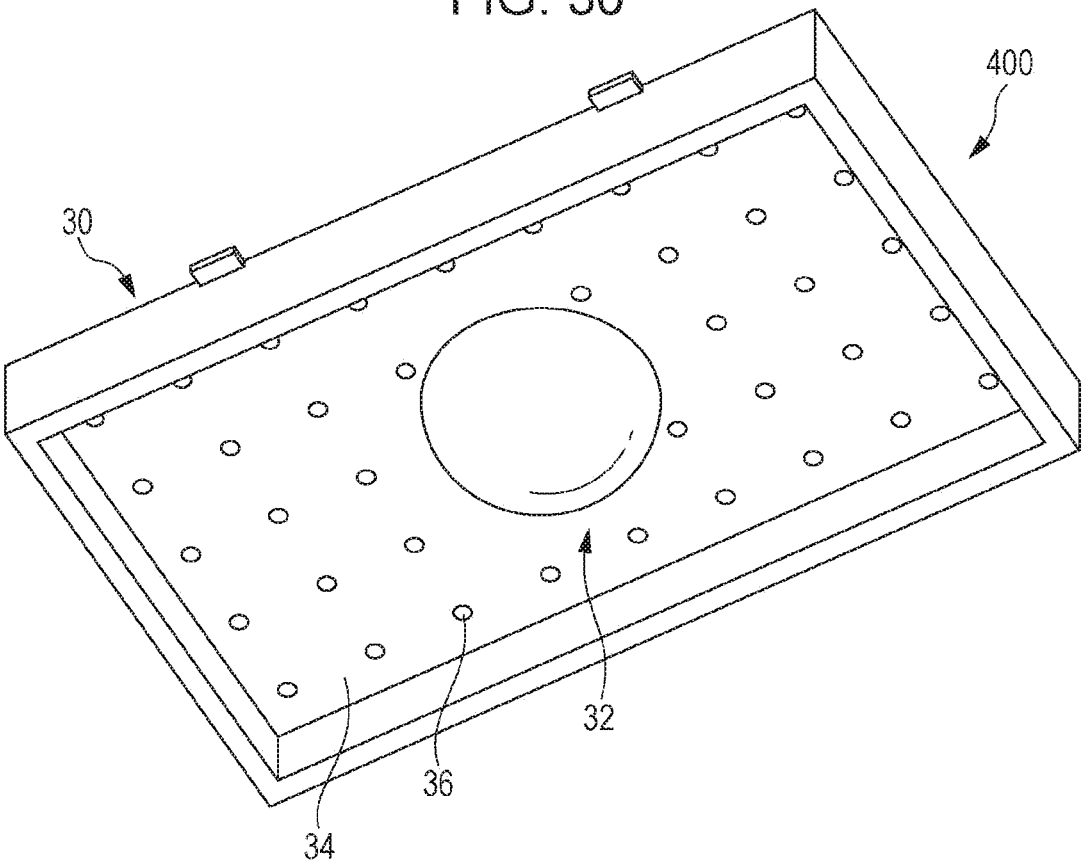
FIG. 30 is a schematic perspective view of a cover of a liquid absorber, according to the third modified example of the embodiment.
Figure 31:
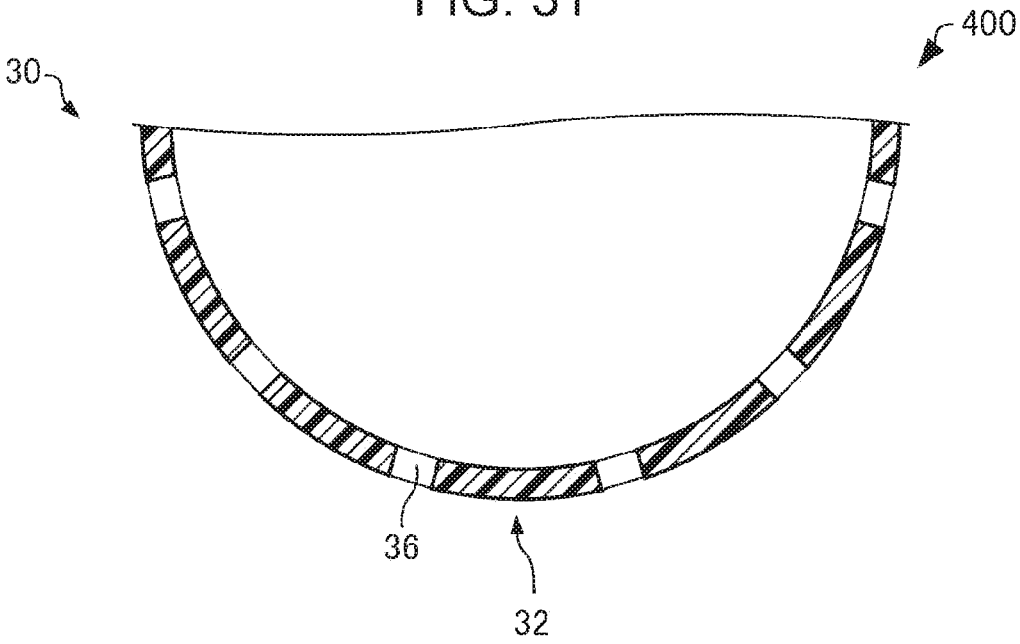
FIG. 31 is a schematic cross-sectional view of the cover of the liquid absorber, according to the third modified example of the embodiment.
Figure 32:
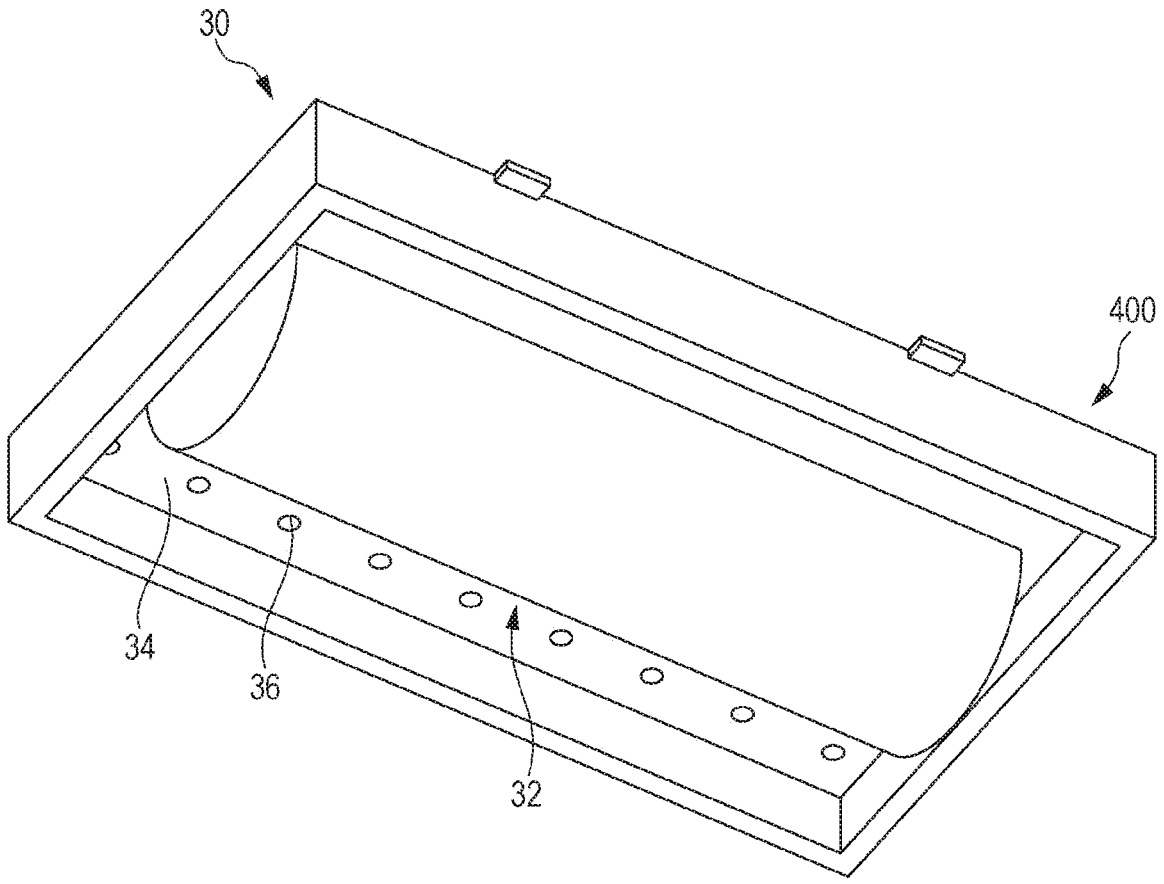
FIG. 32 is a schematic perspective view of a cover of a liquid absorber, according to the third modified example of the embodiment.

As illustrated in FIG. 30 and FIG. 31, the recessed portion 32 may have a hemispherical shape. FIG. 30 is a schematic perspective view of a cover 30, and FIG. 31 is a schematic cross-sectional view of the cover 30 illustrated in FIG. 30. Furthermore, as illustrated in FIG. 32, the recessed portion 32 may have a shape of a half of a cylinder. FIG. 32 is a schematic perspective view of a cover 30. In such a cover 30, in which the recessed portion 32 has a curved portion, ink is unlikely to accumulate. Furthermore, ink can spread in a radial manner to be absorbed. The recessed portions 32 of the covers 30 illustrated in FIG. 30 to FIG. 32 may be formed of a mesh member or a perforated member, for example. Note that the through-holes 36 disposed in the recessed portion 32 are omitted in FIG. 30 and FIG. 32 for convenience.

4. LIQUID EJECTION APPARATUS

Figure 33:
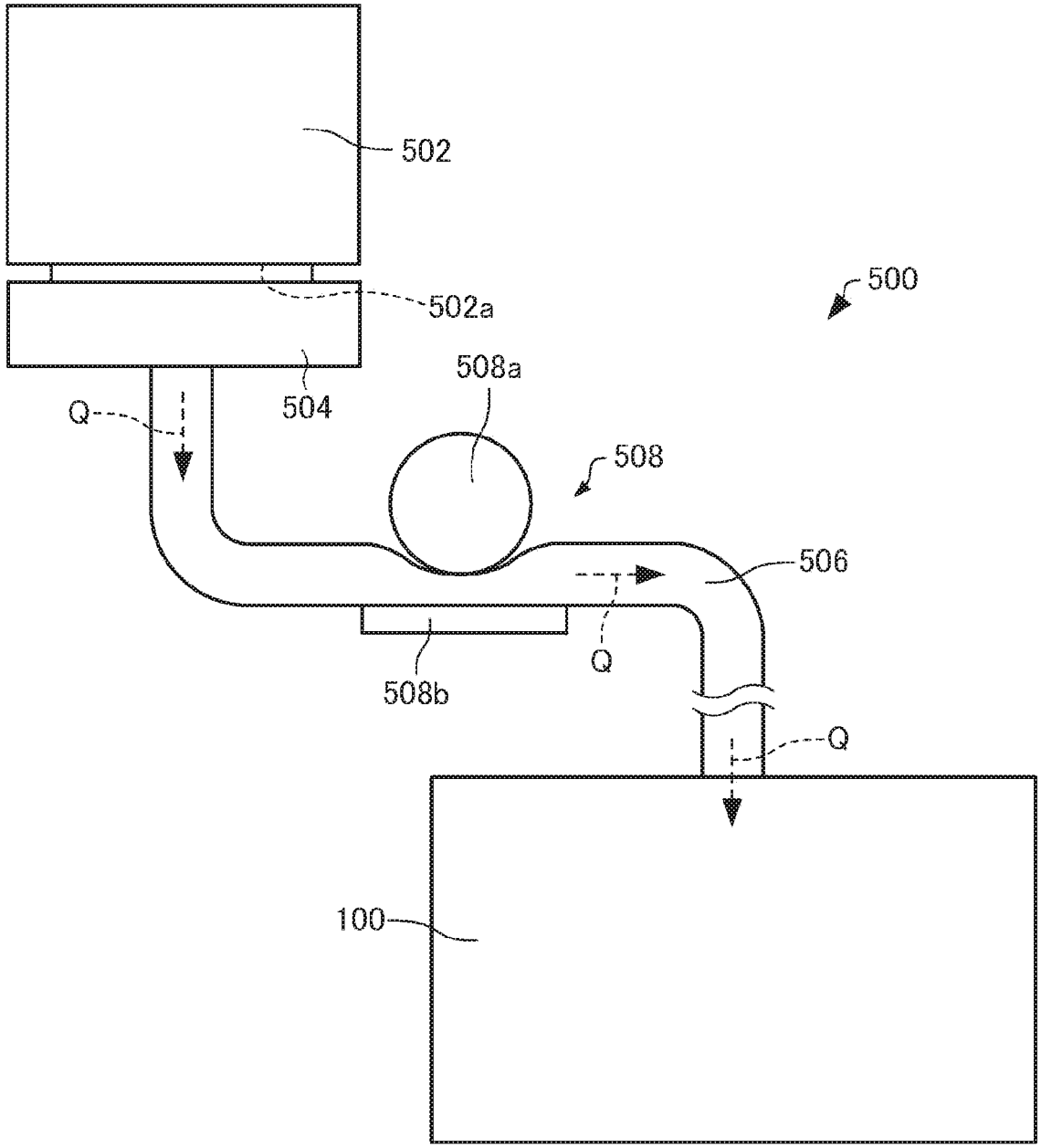
FIG. 33 is a schematic diagram illustrating a liquid ejection apparatus, according to an embodiment.

A liquid ejection apparatus according to an embodiment will now be described with reference to the drawings. FIG. 33 is a schematic diagram illustrating a liquid ejection apparatus 500, according to an embodiment.

As illustrated in FIG. 33, the liquid ejection apparatus 500 includes, for example, a liquid ejection head 502, a capping unit 504, the tube 506, a roller pump 508, and the liquid absorber 100. The liquid ejection head 502 ejects an ink Q. The capping unit 504 prevents clogging of nozzles 502*a* of the liquid ejection head 502. The tube 506 couples the capping unit 504 to the liquid absorber 100. The roller pump 508 delivers the ink Q from the capping unit 504. The liquid absorber 100 collects waste liquid of the ink Q.

The liquid ejection head 502 includes nozzles 502*a*, through which the ink Q is ejected downwardly. The liquid ejection head 502 can perform printing on a recording medium (not illustrated), such as a plain paper copier (PPC) sheet, by moving relative to the recording medium and ejecting the ink Q onto the recording medium.

The capping unit 504 prevents clogging of the nozzles 502*a* in a manner such that when the liquid ejection head 502 is in standby position, the roller pump 508 is actuated to cause the capping unit 504 to apply suction collectively to the nozzles 502*a*.

The tube 506 allows the ink Q, which is sucked through the capping unit 504, to pass through the tube 506 to the liquid absorber 100. The tube 506 may have flexibility, for example.

The roller pump 508 is located at a portion along the tube 506. The roller pump 508 includes a roller member 508*a* and a holder member 508*b*, which holds the portion of the tube 506 with the roller member 508*a*. Rotation of the roller member 508*a* generates a suction force in the capping unit 504 via the tube 506. Further, continuous rotation of the roller member 508*a* enables the ink Q adhering to the nozzles 502*a* to be delivered to the liquid absorber 100. The ink Q is delivered to the liquid absorber 100 and absorbed as a waste liquid.

The liquid absorber 100 is attachably and detachably mounted to the liquid ejection apparatus 500. In a state in which the liquid absorber 100 is mounted to the liquid ejection apparatus 500, the liquid absorber 100 absorbs the ink Q, which is ejected from the liquid ejection head 502. The liquid absorber 100 is a so-called waste liquid tank. When the amount of absorbed ink Q in the liquid absorber 100 has reached a limit, the liquid absorber 100 can be replaced with a new, unused liquid absorber 100.

Note that whether the amount of absorbed ink Q in the liquid absorber 100 has reached a limit may be detected by a detector (not illustrated) of the liquid ejection apparatus 500. Furthermore, when the amount of absorbed ink Q in the liquid absorber 100 has reached a limit, a notification of the fact may be made by a built-in notification unit of the liquid ejection apparatus 500, such as a monitor.

In present disclosure, one or more elements may be omitted, and various embodiments and/or modified examples may be combined together, as long as the features and effects described in the present application are retained.

The present disclosure is not limited to the embodiments described above, and various other modifications may be made. For example, the present disclosure includes configurations substantially identical with the configurations described in the embodiments. "Substantially identical configurations" are, for example, configurations in which functions, methods, and results are identical or configurations in which objects and effects are identical. Furthermore, the present disclosure includes configurations in which one or more non-essential elements of the configurations described in the embodiments are replaced with different elements. Furthermore, the present disclosure includes configurations that produce an effect identical with that of the configurations described in the embodiments or configurations that make it possible to achieve an object identical with that of the configurations. Furthermore, the present disclosure includes configurations in which one or more elements of the known art are added to any of the configurations described in the embodiments.

What is claimed is:

1. A liquid absorber comprising:

a liquid absorption member that absorbs liquid, the liquid absorption member including a fiber and a liquid-absorbent resin;

a case in which the liquid absorption member is stored; and a cover that covers the liquid absorption member, the cover including through-holes through which the liquid is to pass, wherein the cover includes a recessed portion recessed toward the liquid absorption member, the recessed portion being disposed at a location to which the liquid is to be discharged, and the through-holes are disposed at least in the recessed portion.

2. The liquid absorber according to claim 1, wherein the recessed portion includes a bottom portion and a sidewall portion, and the through-holes are disposed in the bottom portion.

3. The liquid absorber according to claim 2, wherein some of the through-holes are disposed in the sidewall portion.

4. The liquid absorber according to claim 2, wherein the bottom portion includes protruding portions protruding toward the liquid absorption member.

5. The liquid absorber according to claim 1, wherein the cover includes a peripheral portion, the peripheral portion being a portion other than the recessed portion, and some of the through-holes are disposed in the peripheral portion.

6. The liquid absorber according to claim 1, wherein openings of the through-holes have a maximum length of 0.67 mm or greater and 8.01 mm or less, and the openings of the through-holes have an area of 0.18 $mm^2$ or greater and 64 $mm^2$ or less.

7. The liquid absorber according to claim 1, wherein the cover has an open area fraction of 0.08% or greater and 95% or less.

8. The liquid absorber according to claim 7, wherein the open area fraction of the cover is 2.19% or greater and 80% or less.

9. The liquid absorber according to claim 1, wherein the liquid absorption member includes an assembly of small pieces, and each of the small pieces includes a substrate and the liquid-absorbent resin, the substrate including the fiber, the liquid-absorbent resin being supported by the substrate.

10. The liquid absorber according to claim 9, wherein the liquid-absorbent resin is held between a pair of portions of the substrate.

11. A liquid ejection apparatus comprising:

a liquid ejection head; and the liquid absorber according to claim 1, the liquid absorber being configured to absorb the liquid, the liquid being ejected from the liquid ejection head.

12. A liquid absorber comprising:

a liquid absorption member that absorbs liquid, the liquid absorption member including a fiber and a liquid-absorbent resin;

a case in which the liquid absorption member is stored; and a cover that covers the liquid absorption member, the cover including through-holes through which the liquid is to pass, wherein the cover includes a sidewall portion that surrounds at least a portion of a location of the cover, the location being a location to which the liquid is to be discharged, and the through-holes are disposed in the location to which the liquid is to be discharged.

* * * * *